US012472412B2

(12) United States Patent
Lindsley

(10) Patent No.: US 12,472,412 B2
(45) Date of Patent: Nov. 18, 2025

(54) RETURN APPARATUSES

(71) Applicant: Timothy John Lindsley, San Jose, CA (US)

(72) Inventor: Timothy John Lindsley, San Jose, CA (US)

( * ) Notice: Subject to any disclaimer, the term of this patent is extended or adjusted under 35 U.S.C. 154(b) by 453 days.

(21) Appl. No.: 17/932,349

(22) Filed: Sep. 15, 2022

(65) Prior Publication Data

US 2024/0091615 A1 Mar. 21, 2024

(51) Int. Cl.
*A63B 69/00* (2006.01)

(52) U.S. Cl.
CPC .. *A63B 69/0002* (2013.01); *A63B 2069/0008* (2013.01)

(58) Field of Classification Search
CPC ..... A63B 69/0002; A63B 2069/0008
USPC ..... 473/451
See application file for complete search history.

(56) References Cited

U.S. PATENT DOCUMENTS 3,498,613 A 3/1970 Dreyer
3,874,662 A 4/1975 Harrington
3,885,790 A * 5/1975 Parr ..... A63B 69/0079 473/427
4,125,230 A 11/1978 Fischer
4,278,257 A 7/1981 Garcia et al.
4,660,835 A 4/1987 Locurto
4,778,177 A 10/1988 Taksony
4,915,388 A 4/1990 Serin
5,018,729 A * 5/1991 Wilkerson ..... A63B 69/0079 473/427
5,275,396 A * 1/1994 Sudia ..... A63B 69/0091 473/427
5,386,988 A * 2/1995 Sung ..... A63B 69/0079 473/423
5,415,396 A * 5/1995 Huang ..... A63B 69/0079 473/417
5,711,724 A * 1/1998 McGovern ..... A63B 69/0091 473/427
5,853,334 A 12/1998 Winebrenner
5,882,270 A 3/1999 Daugherty
5,997,405 A 12/1999 Russell et al.
6,398,671 B1 6/2002 Rio
6,551,204 B1 * 4/2003 Di Re ..... A63B 69/0002 473/417
7,458,907 B2 12/2008 Wang
8,109,844 B1 2/2012 Quinn
9,050,516 B2 6/2015 Holland et al.
9,248,360 B1 2/2016 Gilman
9,283,458 B2 3/2016 Achkar
11,077,349 B2 * 8/2021 Smith ..... A63B 69/0075 473/417

(Continued)

*Primary Examiner* — Mitra Aryanpour
(74) *Attorney, Agent, or Firm* — Andrus Intellectual Property Law, LLP

(57) ABSTRACT

An apparatus for supporting object such that the object can be hit by a hitting device from the apparatus includes a base configured to contact the ground and a tee assembly pivotally coupled to the base and configured to support the object. A string tethers the object to the apparatus, and a return system is activated to retract the string and thereby return the object to the tee assembly after the object is hit from the tee assembly. A lift assembly is coupled to the tee assembly, and the lift assembly is configured to change length of the tee assembly such that the ball is in a position to be hit from the tee assembly.

19 Claims, 32 Drawing Sheets

(56) References Cited

U.S. PATENT DOCUMENTS

| | | | | |
|---|---|---|---|---|
| 2004/0138011 | A1 | 7/2004 | Lin | |
| 2007/0072703 | A1 | 3/2007 | James | |
| 2010/0081522 | A1 | 4/2010 | Schulte | |
| 2012/0190482 | A1 * | 7/2012 | Cottreau ..... | A63B 69/36<br>473/431 |
| 2013/0178314 | A1 | 7/2013 | Raimonda | |

* cited by examiner

RETURN APPARATUSES

FIELD

The present disclosure relates to apparatuses for practicing sports, and specifically, apparatuses that return an object to a practice position such that a sport skill can be repeatedly practiced by the user.

BACKGROUND

Sports such as baseball, softball, and tennis typically involve a player hitting an object (e.g., ball) with a hitting device (e.g., bat, racket) while playing the sport. The player may wish to practice hitting the object prior to the game to improve their skills, and as such, the player may practice by hitting multiple objects. After hitting all the objects, the player retrieves the objects so that the objects can be re-hit. Retrieving the objects is a time-consuming task and wastes time that may otherwise be used to practice hitting the object.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an apparatus for supporting an object such that the object can be hit by a hitting device from the apparatus includes a base configured to contact the ground and a tee assembly pivotally coupled to the base and configured to support the object. A string tethers the object to the apparatus, and a return system is activated to retract the string and thereby return the object to the tee assembly after the object is hit from the tee assembly. A lift assembly is coupled to the tee assembly, and the lift assembly is configured to change the length of the tee assembly such that the ball is in a position to be hit from the tee assembly.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
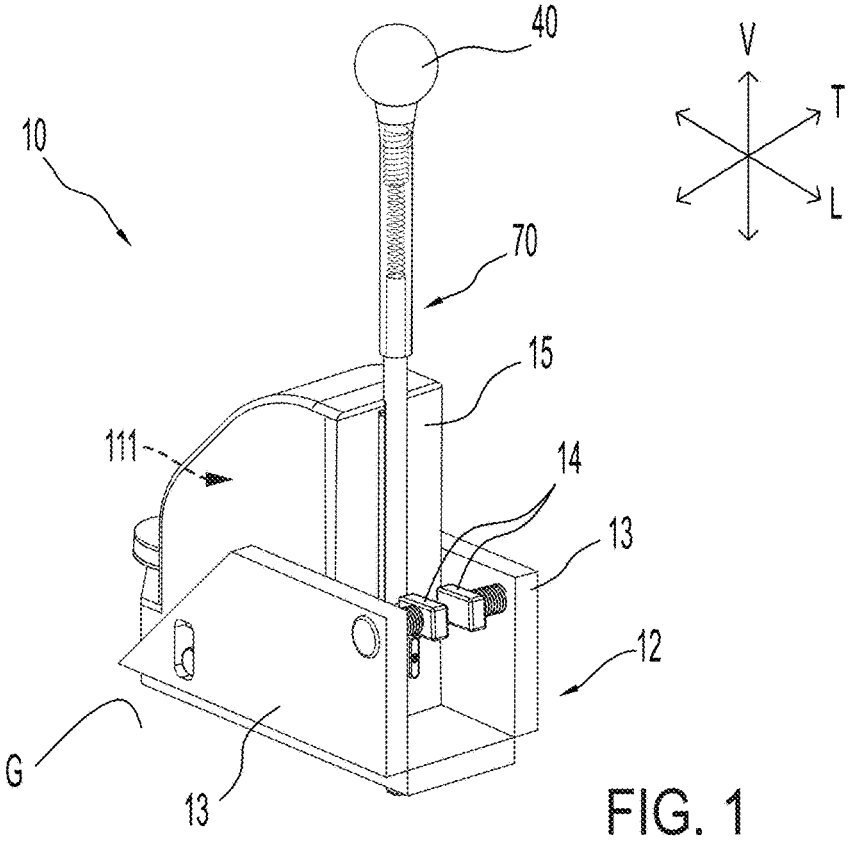
FIG. 1 is a perspective view of an example apparatus of the present disclosure with wings in folded positions.
Figure 2:
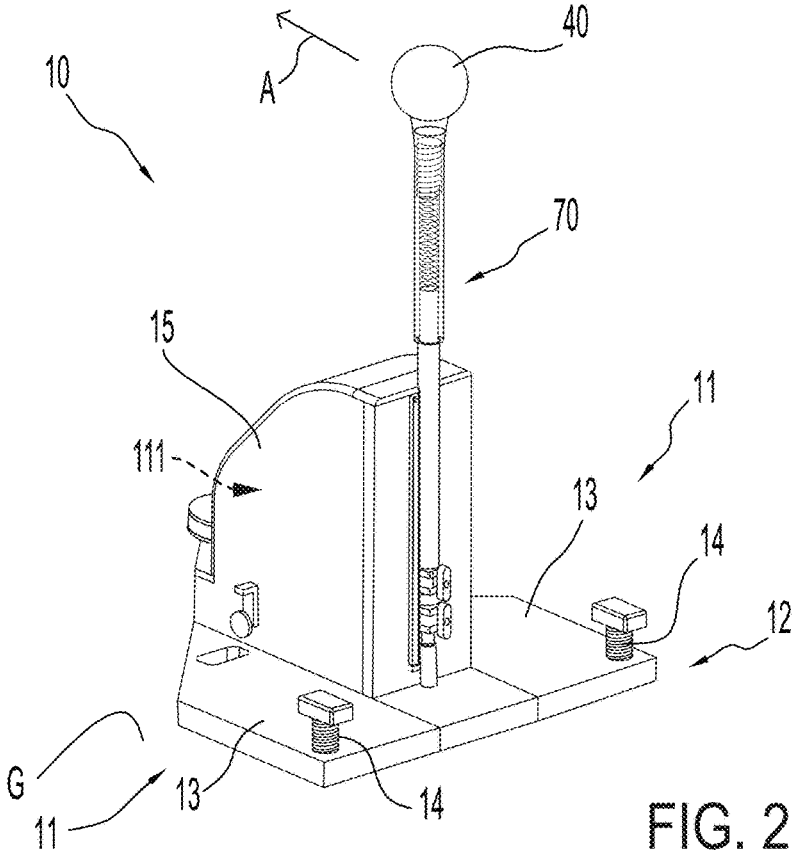
FIG. 2 is a perspective view of the apparatus of FIG. 1 with the legs in the unfolded position and a ball resting on top of a tee assembly.

Referring to FIGS. 1-2, an example apparatus 10 of the present disclosure is depicted. The apparatus 10 includes a base 12 configured to rest on a support surface, such as the ground G, a housing 15 for covering and protecting return systems 111 (described further herein) of the apparatus 10, a tee assembly 70 extending vertically (see arrow V) upward from the base 12, and an object, such as a ball 40, resting on top of the tee assembly 70. The apparatus 10 permits the user to practice hitting the ball 40 off the tee assembly 70 and away from the apparatus 10. The apparatus 10 automatically retrieves the ball 40 and further repositions the ball 40 on the tee assembly 70 so that the user can again practice hitting the ball 40 off the tee assembly 70. The features and components of the apparatus 10 are described in greater detail herein below. Further note that while the example apparatuses 10 depicted in the Figures and described hereinbelow are directed to the sport of baseball and for practicing hitting a baseball from a tee, the components and features described herein can be utilized in other example apparatuses for practicing skills of different sports (e.g., softball, t-ball, tennis, cricket). Further, note that the example apparatuses 10 described herein can be used for practicing skills for different sports other than baseball.

The shape of the base 12 can vary, and in one example, the base 12 is shaped like a baseball home plate. The base 12 includes two opposing wings 13 that are pivotally coupled to a center section of the base 12. The wings 13 can be moved into and between folded position (FIG. 1) and an unfolded position (FIG. 2). When the wings 13 are in the folded positions (FIG. 1), the footprint of the apparatus 10 is advantageously reduced such that the apparatus 10 is more easily transported and stored. When the wings 13 are in the unfolded position (FIG. 2), the footprint of the apparatus 10 is advantageously increased to thereby increase the stability of the apparatus 10 on the ground G (relative to when the wings 13 are in the storage position). Leveling devices 14, such as treaded shafts, are operably coupled to the wings 13 and are for leveling the apparatus 10 relative to the ground and/or increasing the stability of the apparatus 10 on the ground G. In one example, the wings 13 are moved into the unfolded positions (FIG. 2) and the leveling devices 14 are rotated such that the treaded shafts move through threaded openings in the wings 13 to engage the ground G.

Figure 3:
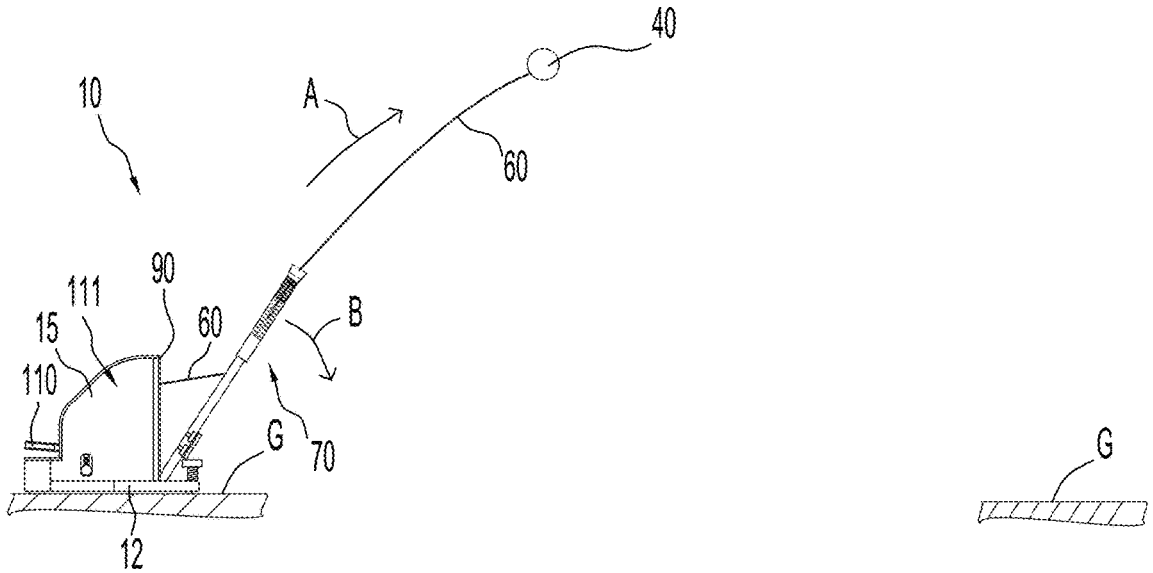
FIGS. 3-4 are side views of the apparatus of FIG. 1 with the ball traveling away from the tee assembly.
Figure 4:
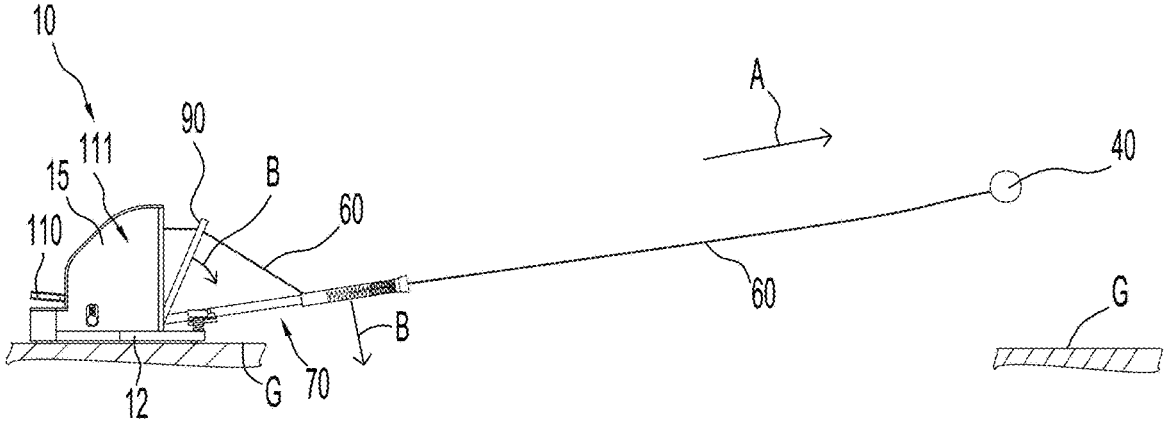
Figure 5:
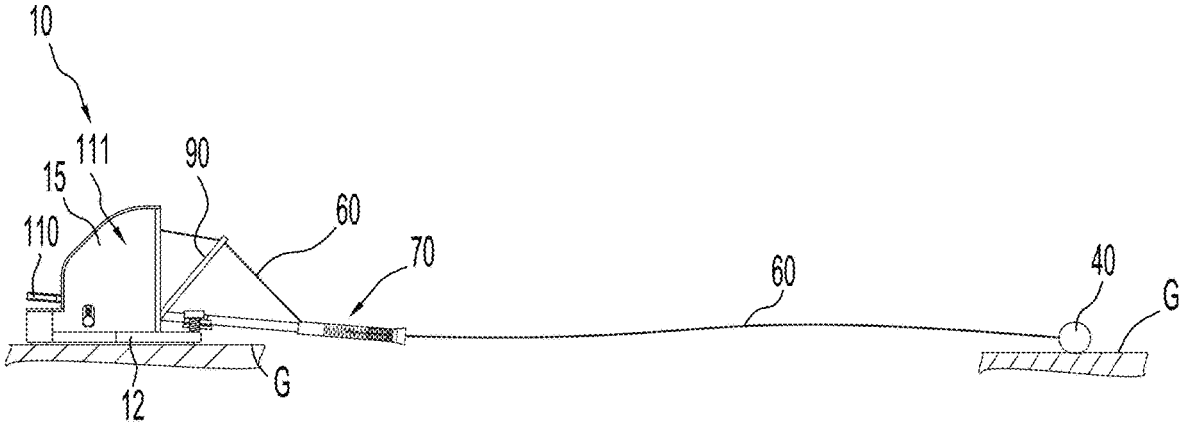
FIG. 5 is a side view of the apparatus of FIG. 1 with the ball resting on the ground.
Figure 6:
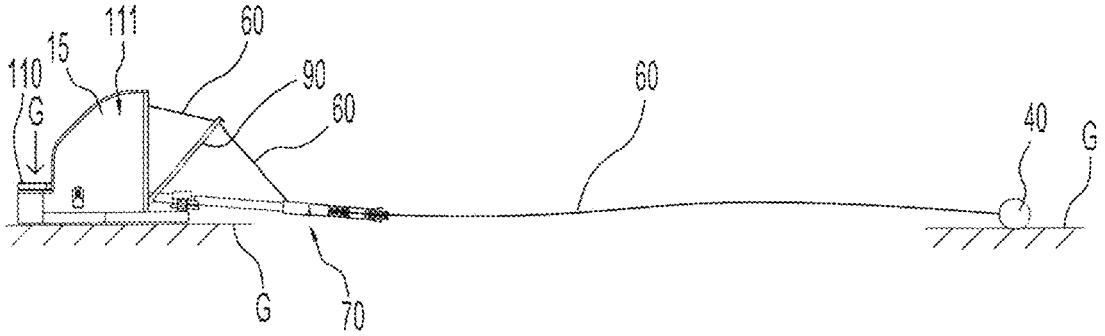
FIG. 6 is a side view of the apparatus of FIG. 1 with the ball resting on the ground and a pedal being depressed.
Figure 7:
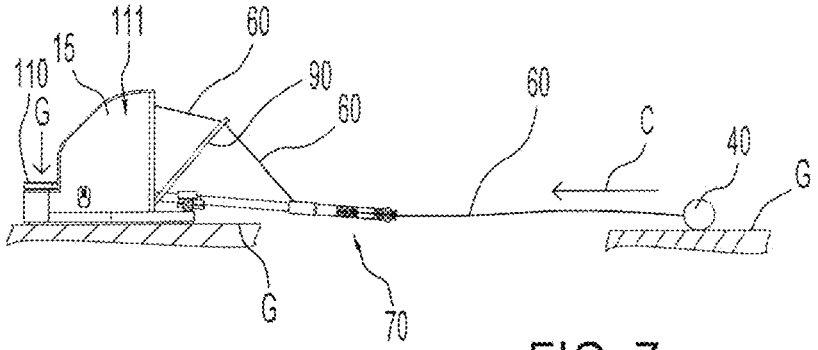
FIG. 7 is a side view of the apparatus of FIG. 1 with the ball being retracted toward the tee assembly.
Figure 8:
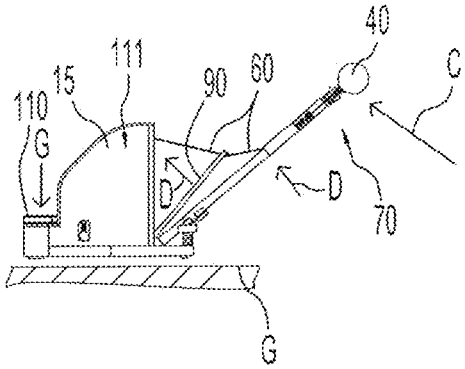
FIGS. 8-9 are side views of the apparatus of FIG. 1 with the ball on top of the tee assembly and the tee assembly pivoting toward a practice position depicted in FIG. 2.
Figure 9:
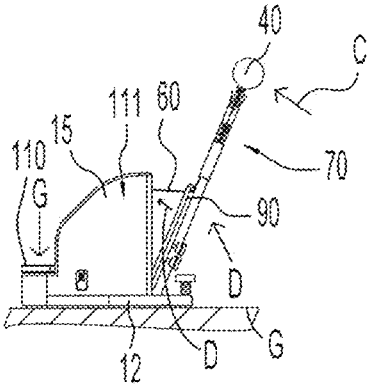

Referring now to FIGS. 3-9, an example sequence of using the apparatus 10 is depicted. To use the apparatus 10, the user positions himself/herself along one of the transverse sides 11 (see FIG. 2 and transverse arrow T). The user then hits the ball 40 off and away from the tee assembly 70 (see the direction of movement of the ball depicted by arrow A) as depicted in FIG. 3. The ball 40 is tethered to the apparatus 10 by a coupling device, such as a string 60, line, rope, cable, or the like, such that as the ball 40 travels away from the tee assembly 70, the length of string 60 pulled out of the apparatus 10 increases (see FIGS. 3-5) and the ball 40 remains coupled to the apparatus 10 by the string 60. FIG. 4 depicts the ball 40 descending by gravity toward the ground G, and FIG. 5 depicts the ball 40 resting on the ground and no longer moving away from the tee assembly 70. Note that as the ball 40 travels away from the tee assembly 70, the tee assembly 70 and an arm 90 are pivoted relative to the base 12 in a first direction downward toward the ground G (see arrow B, described further herein) by the string 60 that passes through the tee assembly 70 and the arm 90. FIGS. 3-9 depict the tee apparatus in various pivoted positions that the tee assembly 70 moves in between as the ball 40 is hit and returned to the top of the tee assembly 70.

Figure 24:
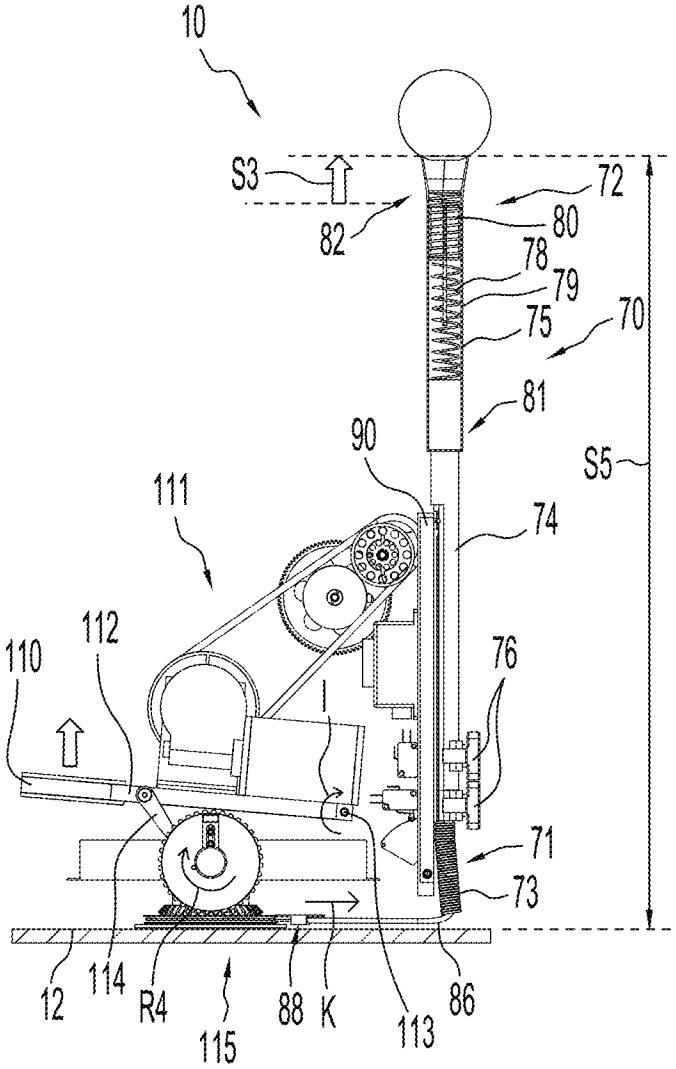
FIG. 24 is a view like FIG. 23 with the ball held vertically above the ball capture spring.
Figure 23:
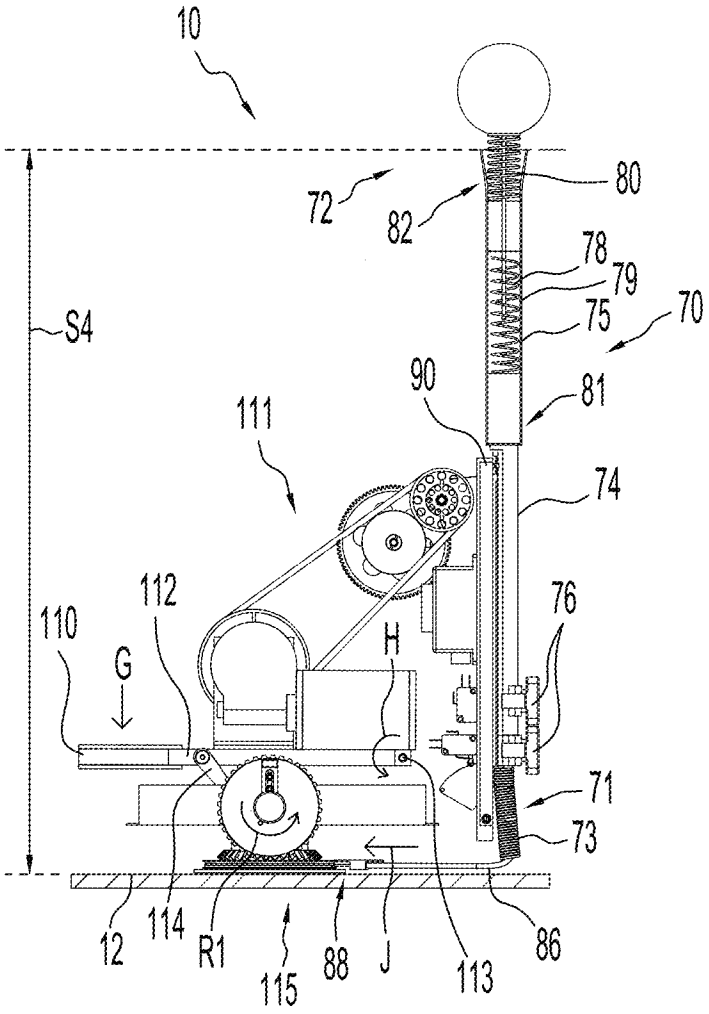
FIG. 23 is a side view of an example apparatus of the present disclosure with the pedal depressed.

After the ball 40 comes to rest on the ground G (see FIG. 5), the user engages (e.g., depresses) a pedal 110 which activates a return system 111 and lift assembly 115 positioned inside the housing 15. The return system 111 retracts and winds the string 60 around a string spool (see FIGS. 7-9) such that ball 40 is pulled/retracted toward the base 12 (see arrow C). The lift assembly 115 re-configures the tee assembly 70 from practice position to retract position. The tee assembly 70 and the arm 90 also pivot in a second direction (see arrow D) as the ball 40 is retracted toward the base 12. Once the ball 40 is repositioned on top of the tee assembly 70 (as depicted in FIG. 23), the user stops engaging the pedal 110 thereby causing the lift assembly 115 to activate (FIG. 24). The apparatus 10 is thereby in a practice position (see FIG. 2) and the user can then re-hit the ball 40.

Tee Assembly

Figure 10:
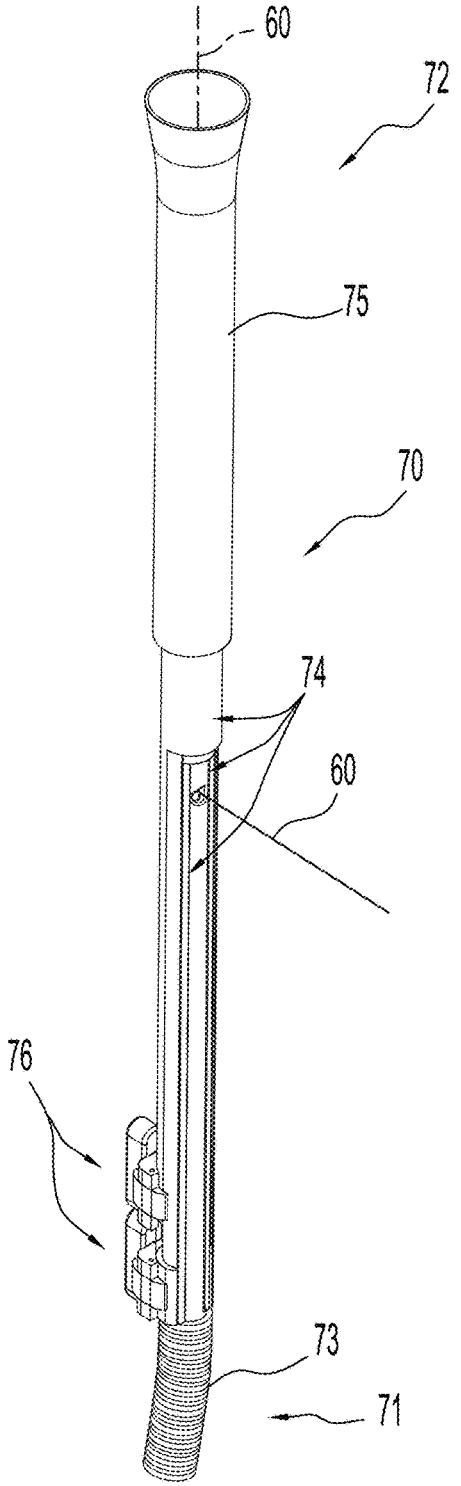
FIG. 10 is a perspective view of an example tee assembly of the present disclosure.
Figure 11:
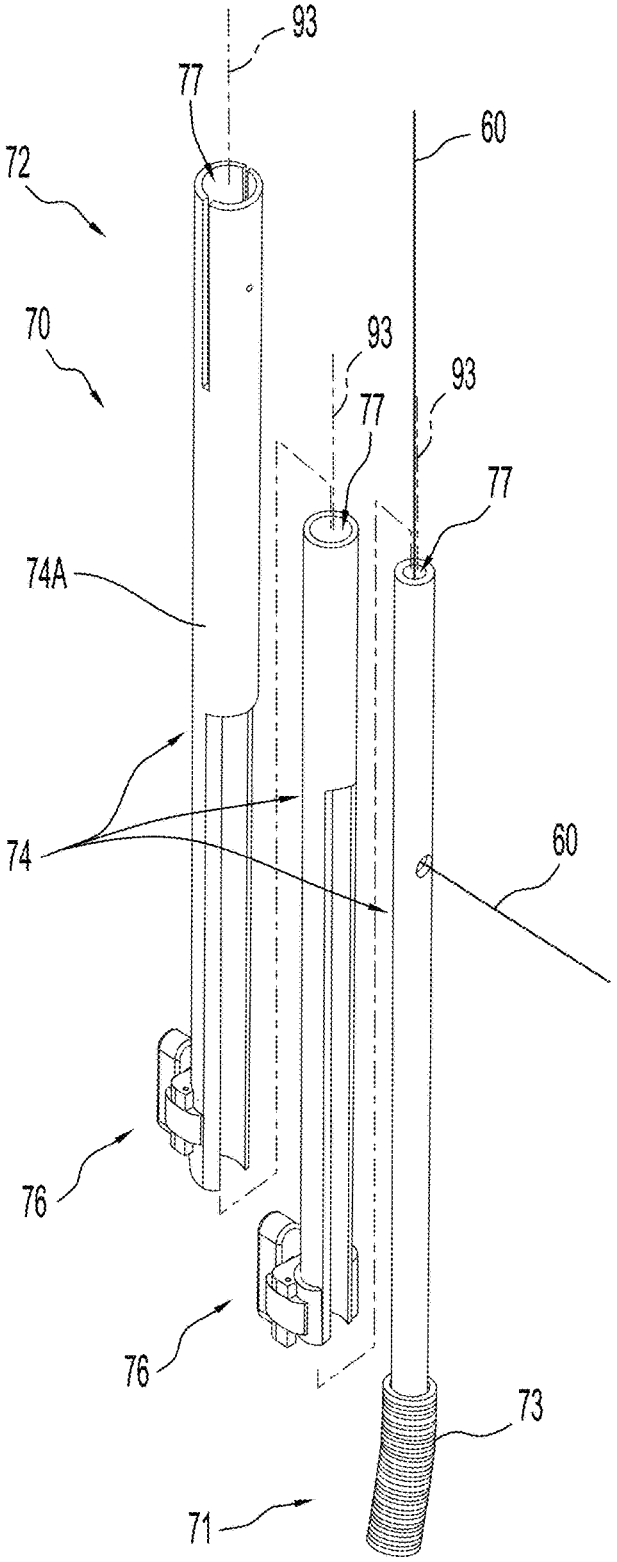
FIG. 11 is an exploded view of the tee assembly depicted in FIG. 10.
Figure 12:
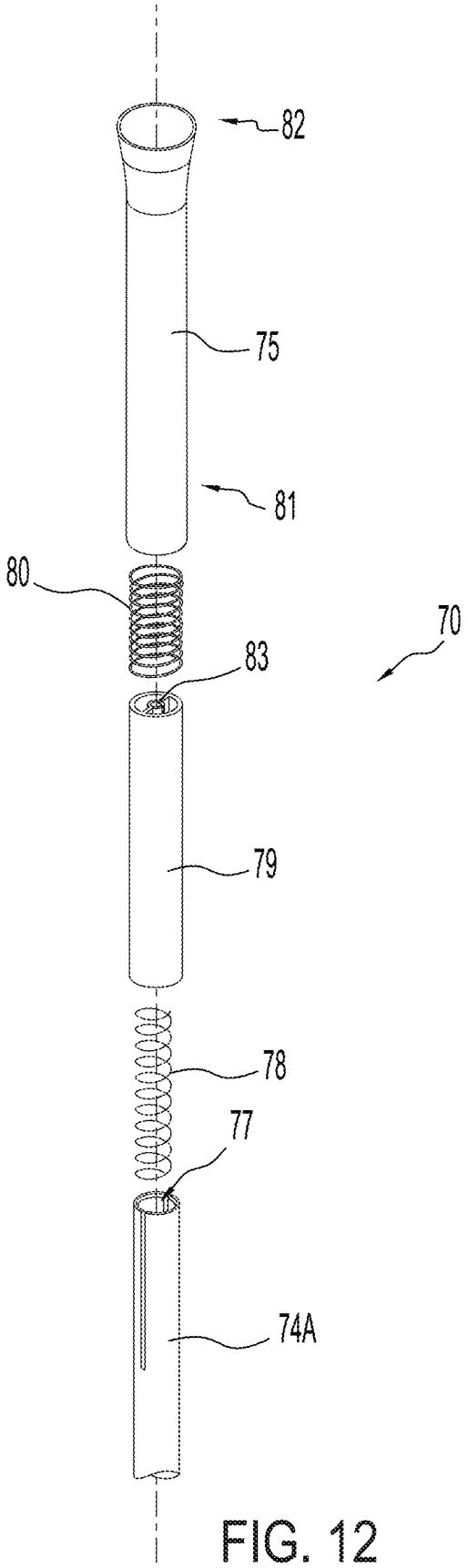
FIG. 12 is a partial exploded view of the tee assembly depicted in FIG. 10.
Figure 13:
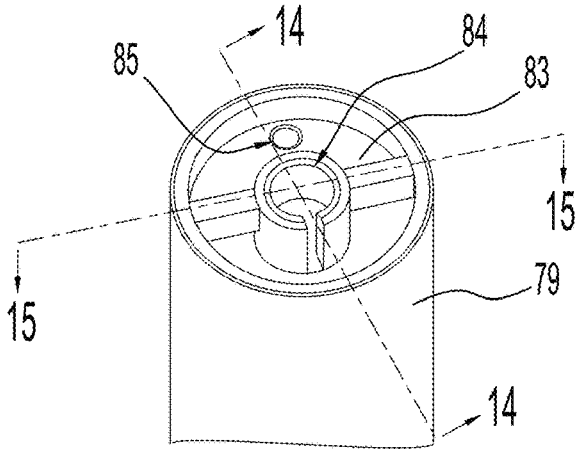
FIG. 13 is a partial perspective view of an example carriage according to the present disclosure.
Figure 14:
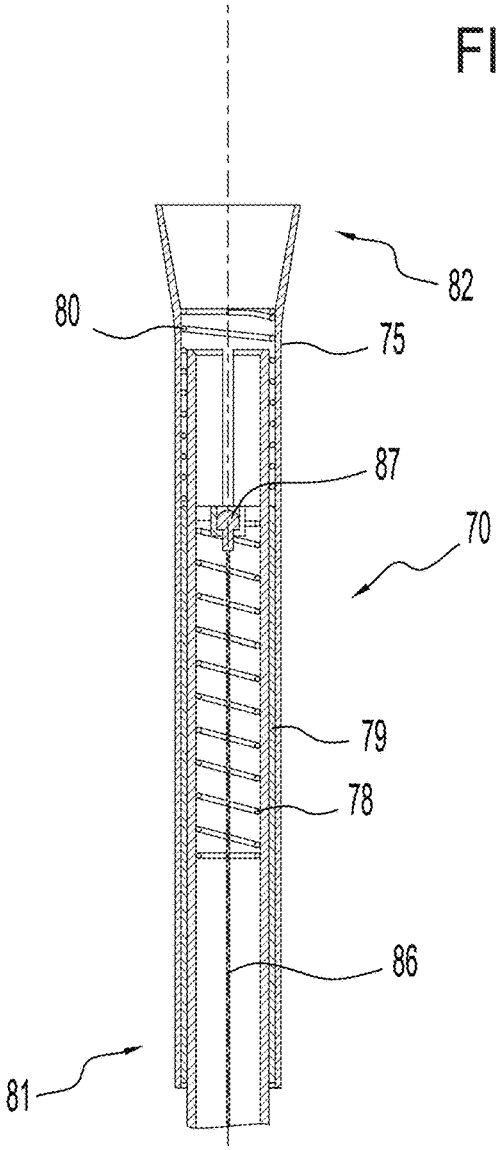
FIG. 14 is a cross-sectional view along line 14-14 on FIG. 13.
Figure 15:
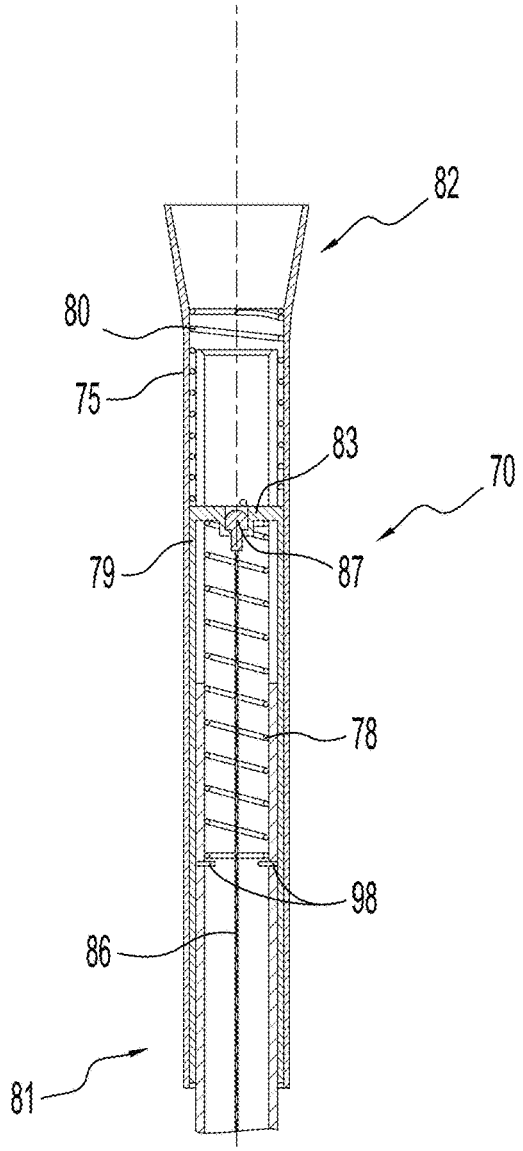
FIG. 15 is a cross-sectional view along line 15-15 on FIG. 13.

An example tee assembly 70 of the present disclosure is depicted in FIGS. 10-15. Referring specifically to FIGS. 10-11, the tee assembly 70 includes a first end 71 coupled to the base 12 or the housing 15 (see FIG. 2) and an opposite second end 72 on which the ball 40 is positioned when the apparatus 10 is in the practice position (FIG. 2). The first end 71 is pivotably connected to the base 12 or the housing 15 (FIG. 2) by any suitable device such as a mechanical assembly (e.g., a pin and bracket assembly) or a coil spring 73. One or more tee tubes 74 extend between the ends 71, 72 of the tee assembly 70, and the tee tubes 74 are nestable and extendable relative to each other (described further herein). As such, the user can move the tee tubes 74 relative to each other and lock the tee tubes 74 relative to each other with clamps 76. Thus, the overall length of the tee assembly 70 is customizable to fit different users (e.g., users with different heights and swing planes). Adjusting the tee tubes 74 relative to each other is described further herein below. Note that in other examples, the tee assembly 70 includes only one tee tube 74 such that the overall length of the tee assembly 70 is fixed.

Referring now to FIGS. 12-19, each tee tube 74 extends along a center axis 93 and has an interior bore 77 (see also FIG. 11). The interior bore 77 of the outermost tee tube 74A (FIG. 12) receives a carriage spring 78 and a carriage 79 (e.g., sleeve-like tubular carriage 79). The carriage 79 has a crossbar 83 (FIG. 13), and the crossbar 83 includes a channel 84 in which a first cable end 87 of a cable 86 is received and held. The cable 86 also includes an opposite second cable end 88 (see FIG. 25) that is coupled to a lifting assembly 115. The crossbar 83 also defines a guide hole 85 through which the string 60 (FIG. 11) freely passes. The carriage spring 78 is a coil spring that biases the carriage 79 and the cup 75 (described further herein) in the first axial direction (see arrow E). The carriage spring 78 is positioned between a set of pins 98 inserted into the outermost tee tube 74A (see FIG. 15) and the crossbar 83.

The cup 75 has a sleeve-like first end 81 that surrounds the outermost tee tube 74A, the carriage 79, and an object or ball capture spring 80. The cup 75 also has an opposite second end 82 on which the ball 40 rests when the apparatus 10 is in the practice position (see FIG. 2). The cup 75 is coupled to the carriage 79 such that axial movement of the carriage 79 causes the cup 75 to axially move with the carriage 79. The ball capture spring 80 is mounted on the end of the outermost tee tube 74A and positioned between the outer surface of the outermost tee tube 74A and the inner surface of the cup 75.

Figure 16:
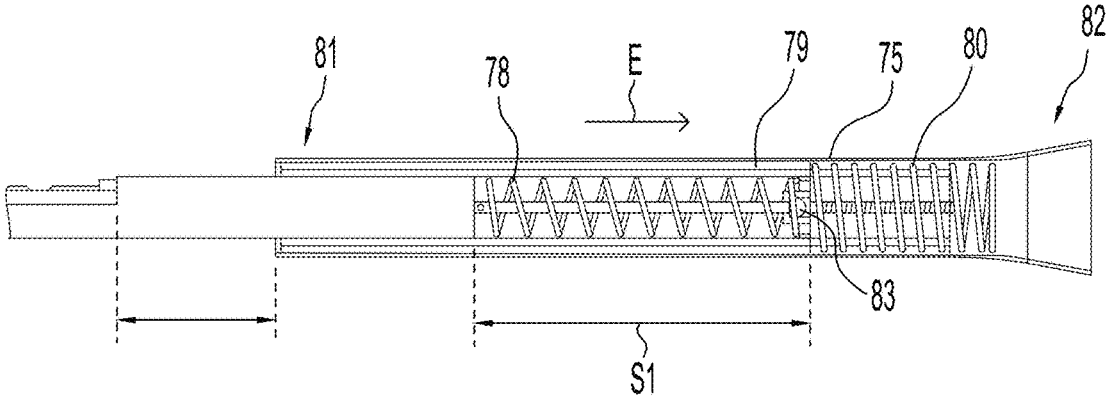
FIG. 16 is a partial side view of an example tee assembly of the present disclosure with a ball capture spring covered by a cup.
Figure 17:
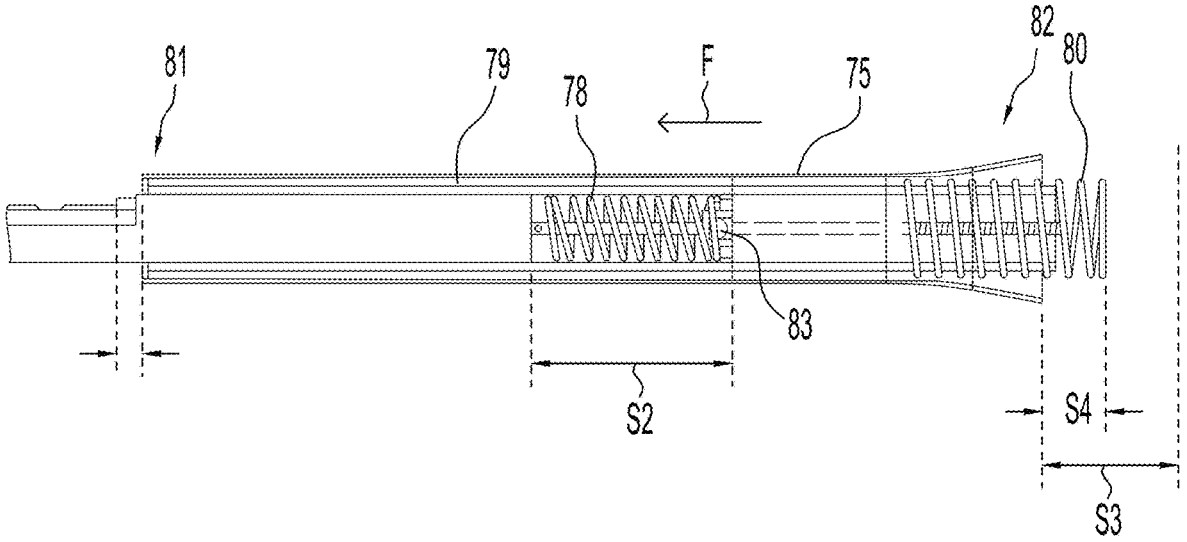
FIG. 17 is a partial side view like FIG. 16 with the ball capture spring exposed.

The carriage 79 and the cup 75 are axially movable to thereby expose or cover the ball capture spring 80. Exposing the ball capture spring 80 is advantageous when the string 60 and the ball 40 are being retracted (as noted above) as the ball capture spring 80 will cushion forces and shock caused when the ball 40 contacts the tee assembly 70 and provide a flexible platform on which the ball 40 makes contact. FIG. 16 depicts the ball capture spring 80 covered by the cup 75, and FIG. 17 depicts the ball capture spring 80 exposed.

In one example operational sequence, the ball 40 is hit by the user and comes to rest on the ground G (as described above, see FIG. 5). The user then depresses the pedal 110 (see FIG. 6 and arrow G) which causes the string 60 to begin retracting into the return system 111 and the ball 40 to be pulled toward the tee assembly 70 (see FIG. 6). Depressing the pedal 110 also causes the second cable end 86 to be tensioned by the lift assembly 115 such that the first cable end 87 applies a force to the carriage 79 directed in the second axial direction (see arrow F on FIG. 17). As such, the carriage 79 compresses the carriage spring 78 (note FIG. 16 depicts the uncompressed spring 78 having length S1 and FIG. 17 depicts the compressed carriage spring 78 having length S2 which is less than the length S1) and moves the cup 75 in the second axial direction (arrow F) thereby exposing the ball capture spring 80. The difference between the uncompressed spring length S1 and the compressed spring length S2 is equal to the axial distance S3 traveled by the cup 75. The exposed portion of the ball capture spring 80 has an exposed length S4. Note that when the tee assembly 70 is in the stationary position (FIG. 23), the tee assembly 70 has a first length (see S4 on FIG. 23), and when the tee assembly 70 is in the practice position (FIG. 24), the tee assembly 70 has a second length (see S5 on FIG. 24). The second length S5 is greater than the first length S4.

Figure 18:
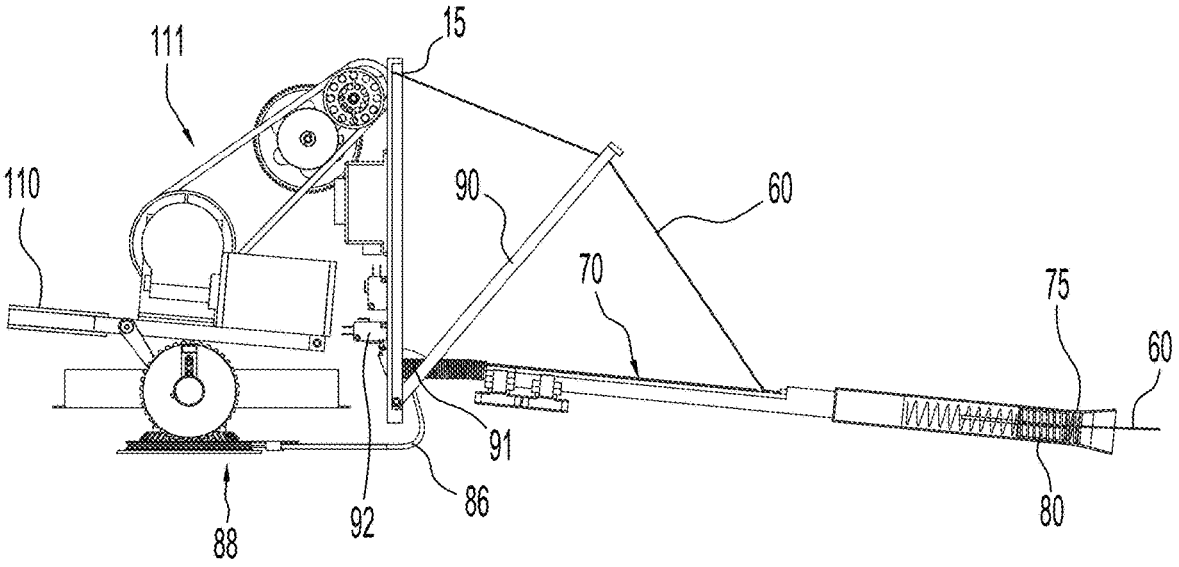
FIG. 18 is a side view of an example apparatus of the present disclosure with the ball capture spring covered by a cup.
Figure 19:
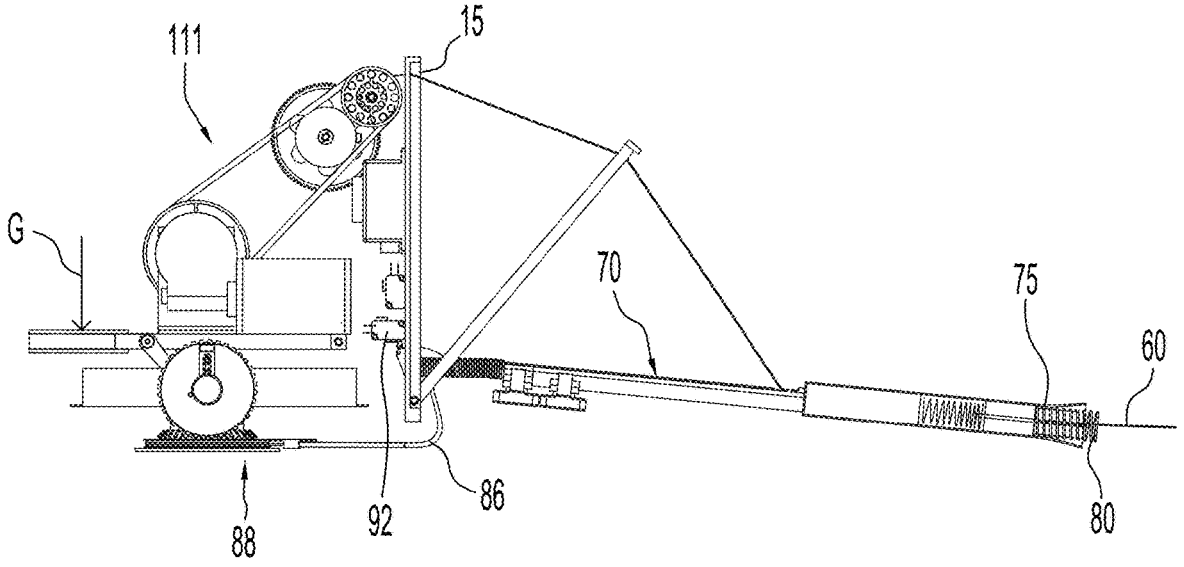
FIG. 19 is a side view like FIG. 18 with the ball capture spring exposed.

FIG. 18 depicts a side view of an example apparatus 10 before the pedal 110 is depressed. Note that the carriage spring 78 is in the uncompressed position and the cup 75 covers the ball capture spring 80 (see also FIG. 16). FIG. 19 depicts a side view of the example apparatus 10 of FIG. 18 when the pedal 110 is depressed (see arrow G). Note that the carriage spring 78 is in the compressed position and the ball capture spring 80 is exposed (see also FIG. 17).

Figure 20:
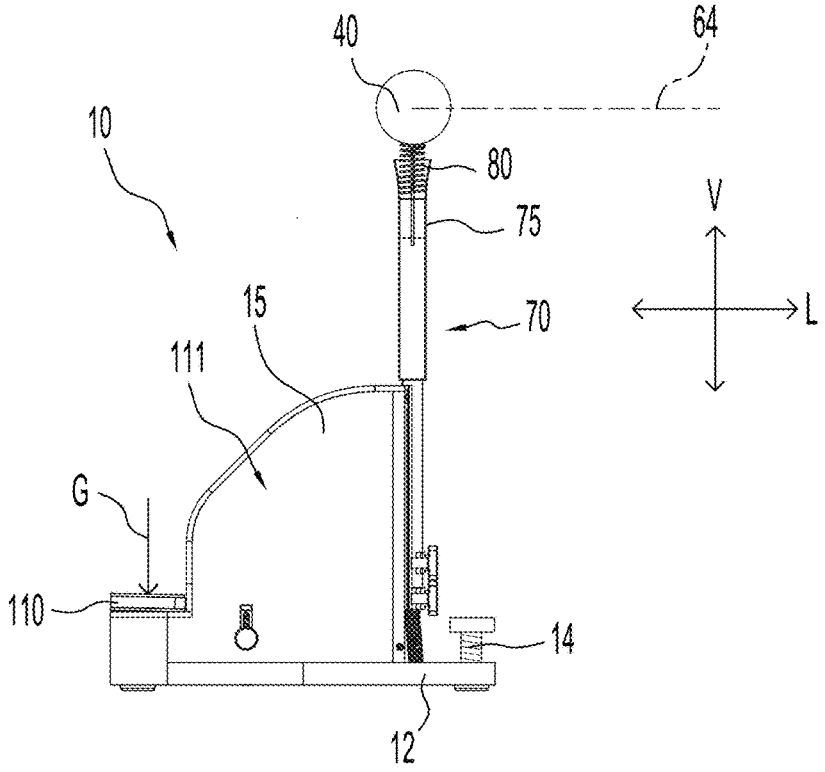
FIG. 20 is a side view of an example apparatus of the present disclosure with the pedal depressed.

The user continues to depress the pedal 110 and the string 60 retracts, the ball 40 comes into contact with the ball capture spring 80 (see FIGS. 6-9), and the tee assembly 70 and the arm 90 are moved into a stationary position depicted in FIG. 20. In the stationary position, the tee assembly 70 no longer pivots and the ball 40 is offset (e.g., vertically offset) from the position of the ball 40 in the practice position (FIG. 2). The ball 40 is held against the ball capture spring 80 by the tension on the string 60 such that the ball 40 acts and compresses the ball capture spring 80. That is, the tension acting on the string 60 acts on the ball 40 and thereby causes the ball 40 to maintain contact with the ball capture spring 80 as the tee assembly 70 is moved into the stationary position depicted in FIG. 20. Furthermore, when movement of the tee assembly 70 stops (i.e. the tee assembly 70 stops moving once into the stationary position depicted in FIG. 20) the tension on the string 60 advantageously counteracts any inadvertent movement of the ball 40 out of contact with the ball capture spring 80. Furthermore, in the event the ball 40 does separate from the ball capture spring 80 as the movement of the tee assembly 70 stops, the string 60 will pull the ball 40 back into contact with the ball capture spring 80.

Figure 21:
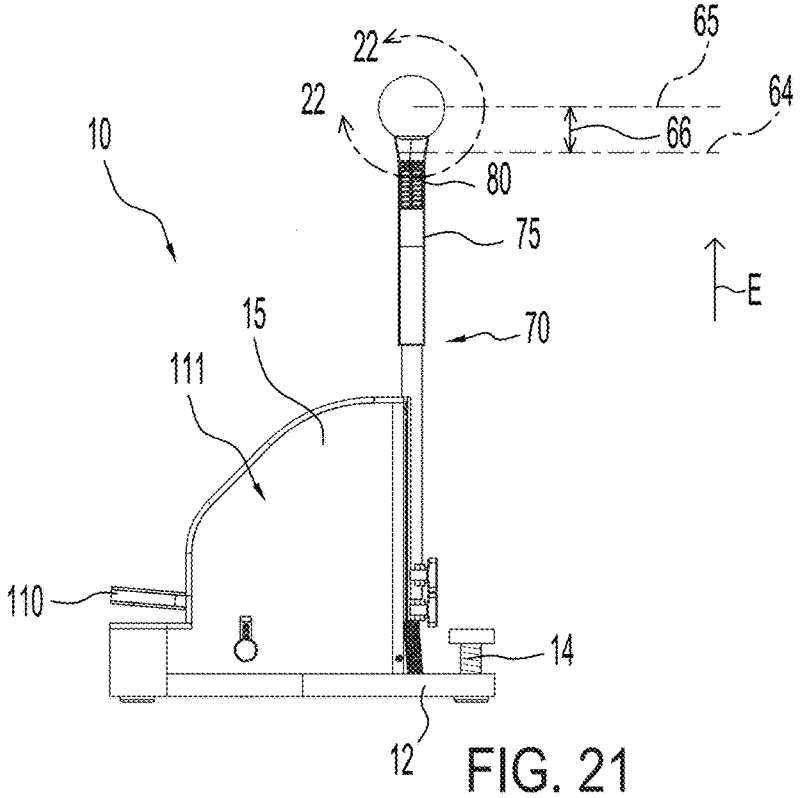
FIG. 21 is a side view like FIG. 20 with the cup vertically holding the ball above the ball capture spring.
Figure 22:
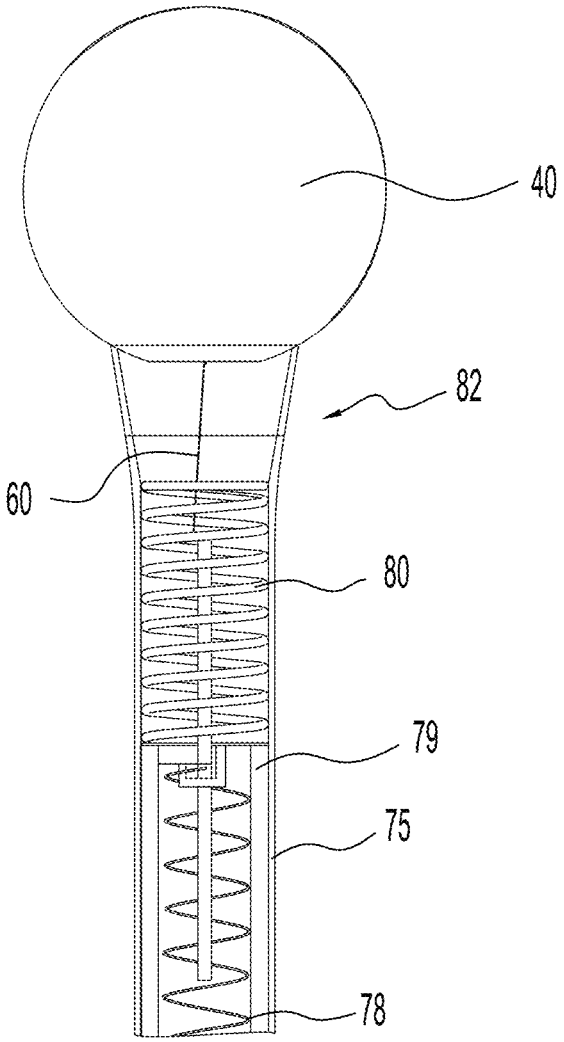
FIG. 22 is an enlarged side view of the tee assembly with the ball held vertically above the ball capture spring. Note a cup and a carriage are depicted as semi-transparent.

After the tee assembly 70 is moved into the stationary position (FIG. 20), the user releases the pedal (See FIG. 21) which releases the tension on the string 60 and the tension on the cable 86 such that the carriage spring 78 moves from the compressed position (FIG. 17) to the uncompressed position (FIG. 18). The carriage spring 78 thereby applies a pulling force on the first cable end 87 of the cable 86 and the moves the carriage 79 and the cup 75 in the first axial direction E. As such, that the cup 75 lifts the ball 40 off the ball capture spring 80 as depicted in FIGS. 21-22. Accordingly, the user can re-hit the ball 40 without damaging the string 60, tee assembly 70, or the return systems 111. Note that when the tee assembly 70 is in the stationary position (FIG. 20) the ball 40 is in a first object position (see line 64 extending from the center of the ball 40 on FIGS. 20-21), and when the tee assembly 70 is in the practice position (FIG. 21) the ball 40 is in a second object position (see line 65 extending from the center of the ball 40 on FIG. 21) is offset (e.g., vertically offset) from the first object position 64. The distance between the first object position 64 and the second object position 65 is depicted as object movement distance 66 on FIG. 21.

Referring to FIGS. 23-24, the lifting up of the ball 40 off the ball capture spring 80 is depicted in greater detail. FIG. 23 is similar to FIG. 20 and depicts the pedal 110 being depressed (arrow G). Note FIGS. 23-34 depict example return system 111 of an example apparatus 10. When the user stops depressing the pedal 110 (as described above), the cup 75 lifts the ball 40 off the ball capture spring 80 as the cup 75 moves axial distance S3.

Figure 25:
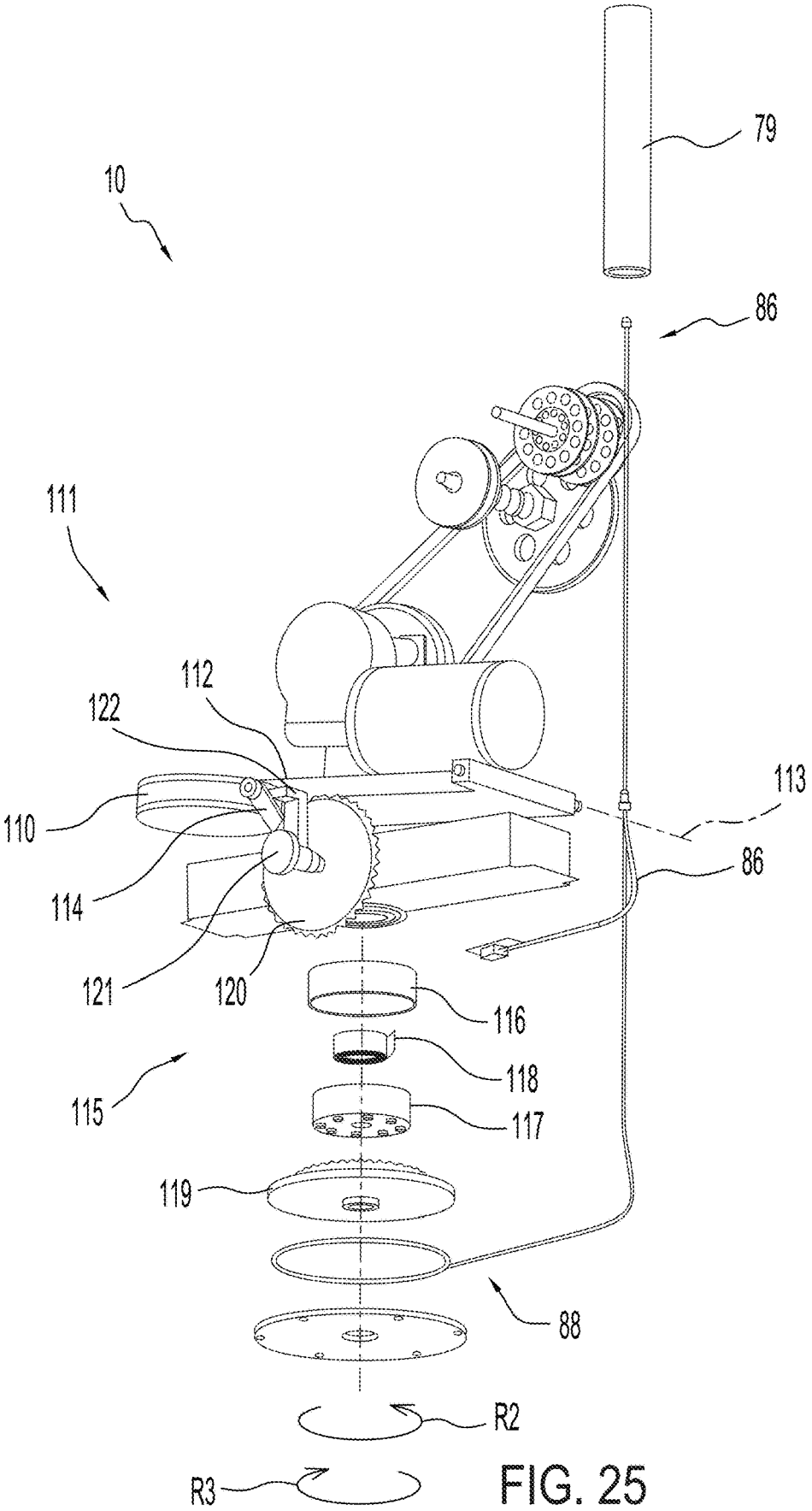
FIG. 25 is an exploded view of an example lift assembly of the present disclosure. An example return system of the present disclosure is depicted adjacent to the lift assembly.

The pedal 110 is coupled to a platform 112 that is pivotable about a first axis 113. A leg 114 extends away from platform 112 and is for engaging the lift assembly 115. As depicted in FIG. 25, the lift assembly 115 includes an upper housing 116 and a lower housing 117. A constant force spring 118 is between and within the housings 116, 117. The lower housing 117 is connected to a spool gear 119, and the second cable end 88 of the cable 86 is coupled to and/or wound around the spool gear 119. A drive gear 120 is coupled to the spool gear 119, and the leg 114 is coupled to the drive gear 120.

In operation, when the user depresses the pedal 110 (see arrow G on FIG. 23), the platform 112 pivots in a first direction (arrow H) causing the leg 114 to rotate the drive gear 120 in a first direction R1. The drive gear 120 thereby rotates the spool gear 119 in a second rotational direction R2 (see FIG. 25) such that second cable end 88 is wound and/or tensioned around the spool gear 119 (see arrow J on FIG. 23 depicting the direction of movement of the cable 86). As such, the first cable end 87 applies a pulling force on the carriage 79 (FIG. 12) and the string 60 is retracted as described above.

Figure 26:
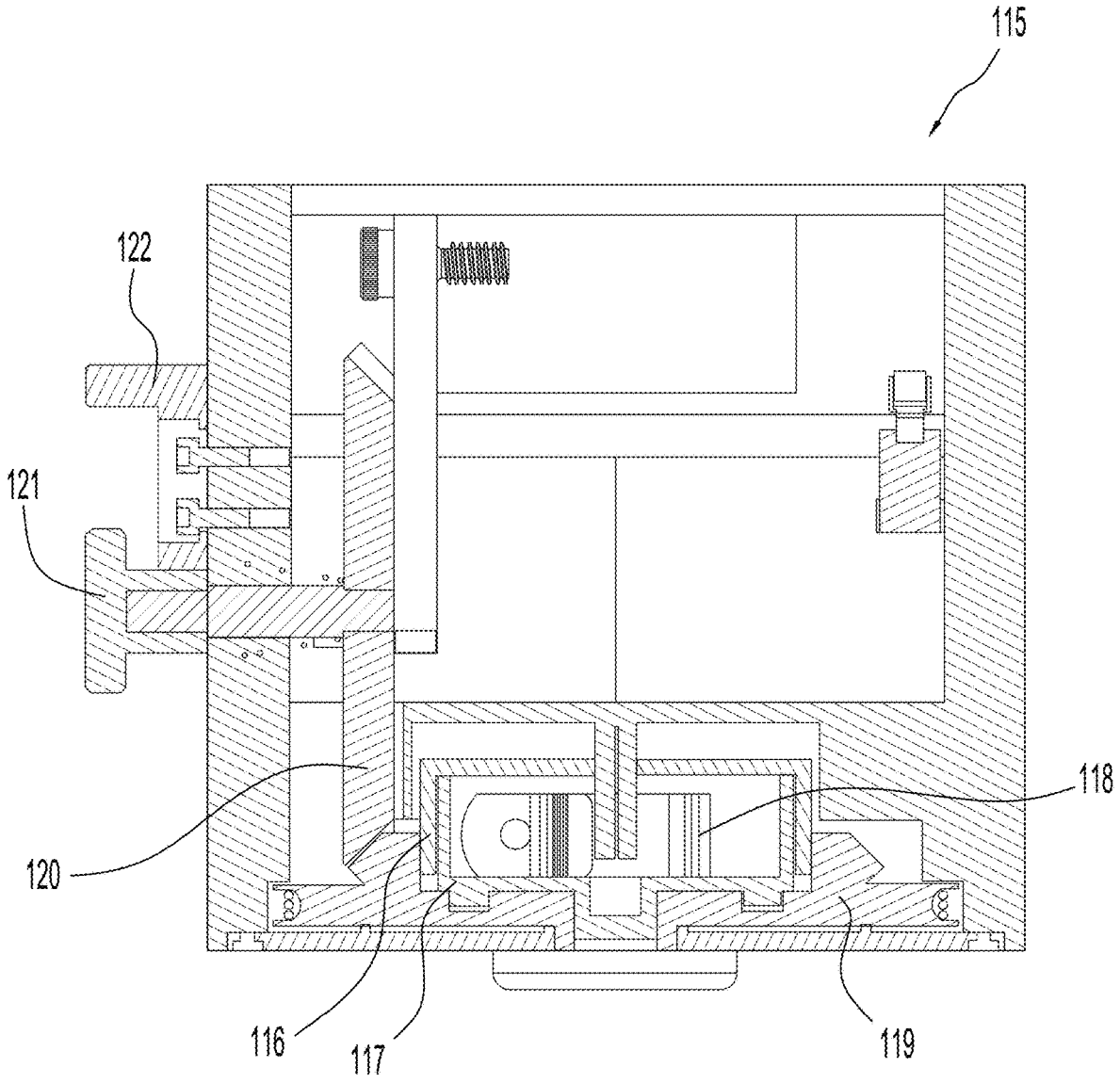
FIG. 26 is a cross-sectional view of an example lift assembly of the present disclosure.

Once the ball 40 is on top of the tee assembly 70 and the tee assembly 70 is in the stationary position depicted in FIG. 20, the user stops depressing the pedal 110 allowing the carriage spring 78 to expand pulling the cable end 88 away from the spool gear 119 and rotating the spool gear 119 in the third rotational direction (arrow R3 on FIG. 25) opposite the second rotational direction R2. The rotation of the spool gear 119 allows the cable 88 to be pulled away from the spool gear 119 (direction of movement of the cable 86 indicated by arrow K on FIG. 24) by the carriage spring 78 (as noted above). The spool gear 119 rotates the drive gear 120 in a fourth rotational direction (see arrow R4 on FIG. 24) opposite the first rotational direction R1 on FIG. 23 such that the leg 114, the platform 112, and the pedal 110 pivot in the second pivot direction (see arrow I on FIG. 24) into the positions depicted in FIG. 24. As such, the pedal 110 is ready to be depressed after the ball 40 is re-hit as described above. FIG. 26 is a cross-sectional view of a lift assembly 115.

Figure 27:
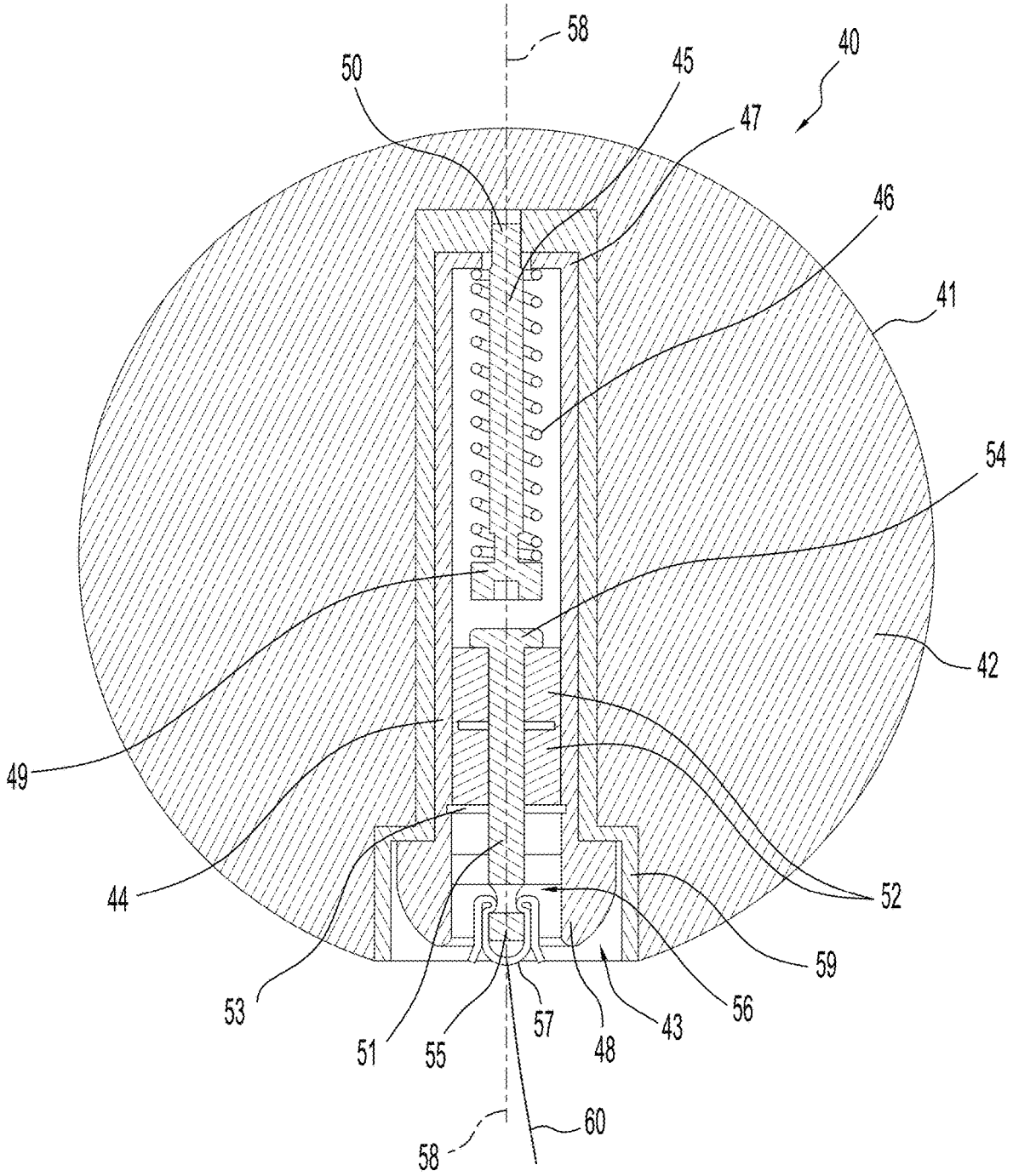
FIG. 27 is a cross-sectional view of an example ball of the present disclosure.
Figure 28:
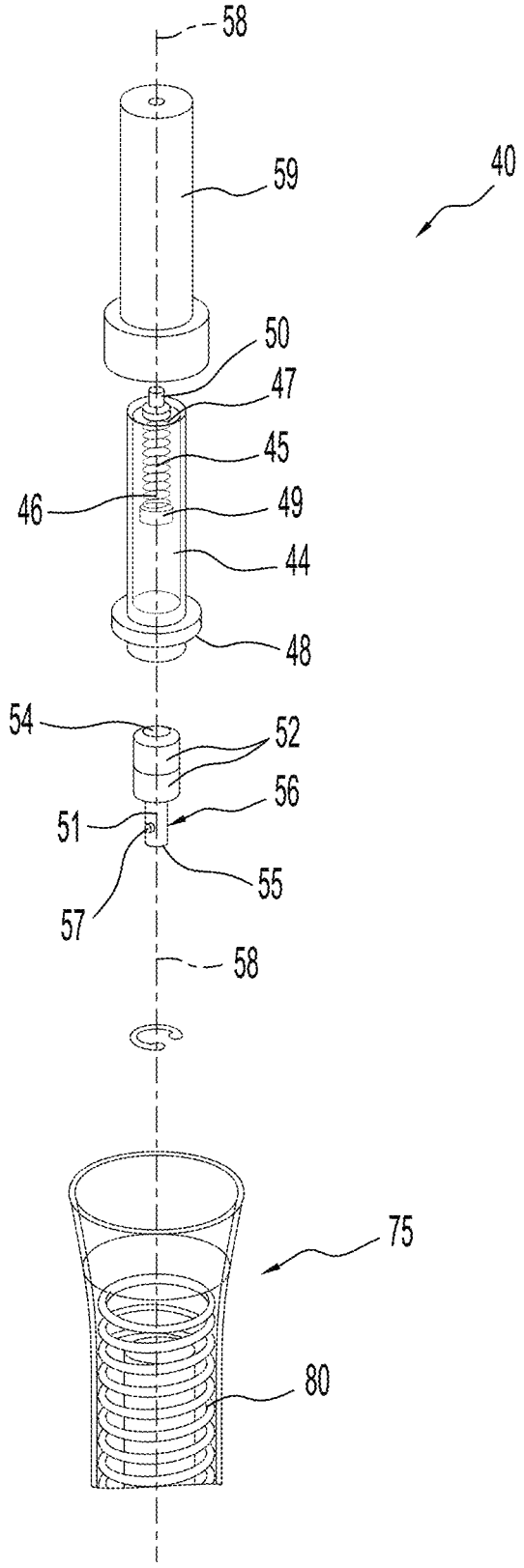
FIG. 28 is an exploded view of the ball depicted in FIG. 27. Note that an outer surface and a body of the ball are excluded for clarity.
Figure 29:
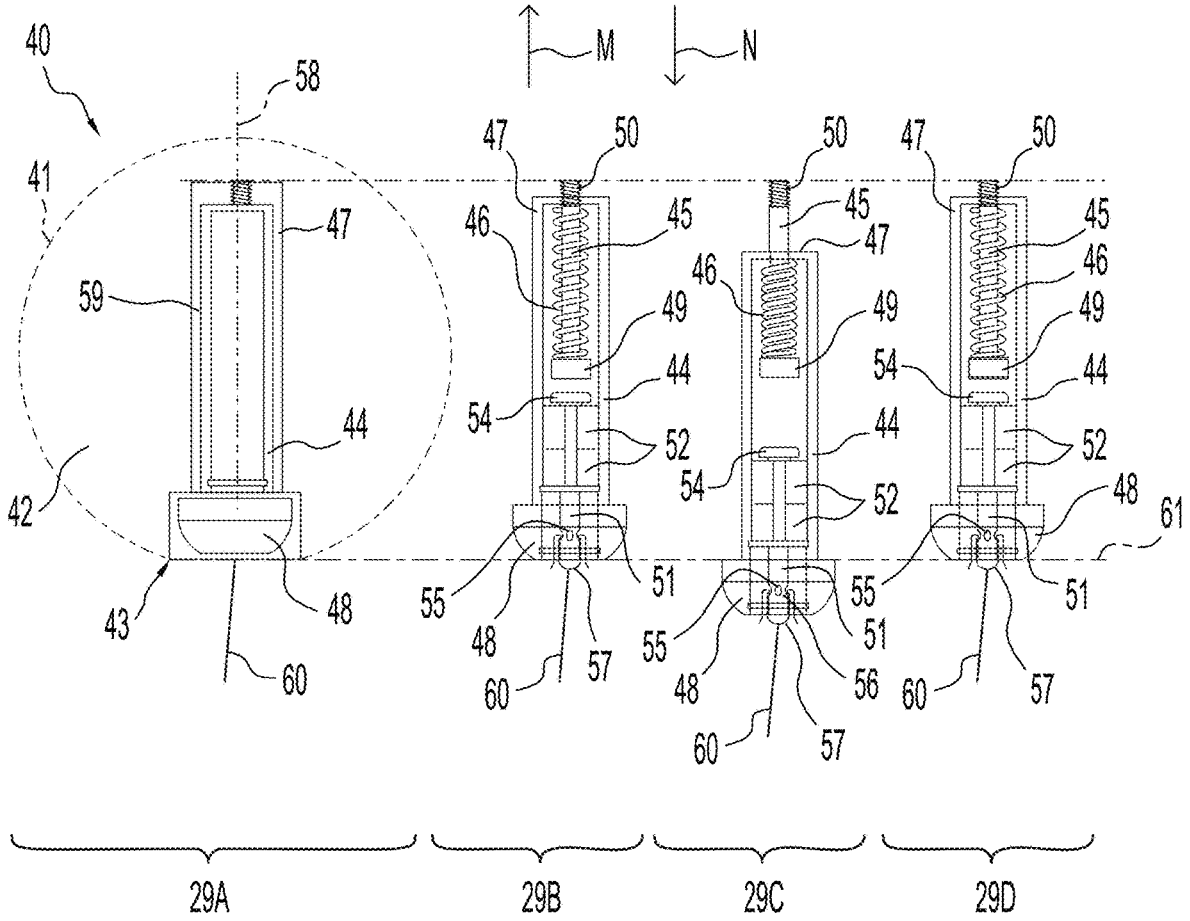
FIG. 29 depicts several images 29A-29D of an example operation of internal components of the ball according to the present disclosure.

Referring to FIGS. 27-29, an example ball 40 of the present disclosure is depicted. The ball 40 includes an outer surface 41 and a body 42. A ball bore 43 is defined in the body 42, and a ball sleeve 59 is anchored in the ball bore 43 with mechanical fasteners or adhesives. A plunger 44 is slidably received in the ball sleeve 59, and a shoulder screw 45 holds a compression spring 46 between a first plunger end 47 of the plunger 44 and a head 49 of the shoulder screw 45. A threaded end 50 of the screw freely passes through the first plunger end 47 and engages with screw threads of the ball sleeve 59.

The second plunger end 48 is open, and a clevis pin 51 is positioned in the plunger 44 with sealed bearings 52 and a snap ring 53. The pin 51 has a first pin end 54 and an opposite second pin end 55. The first pin end 54 has a larger width than the second pin end 55, and the second pin end 55 has a groove or hole 56. A string clip 57 connects the string 60 to the hole 56 and the second pin end 55. The ball sleeve 59, the plunger 44, the screw 45, and the pin 51 are aligned along a center axis 58 (FIG. 27).

Figure 30:
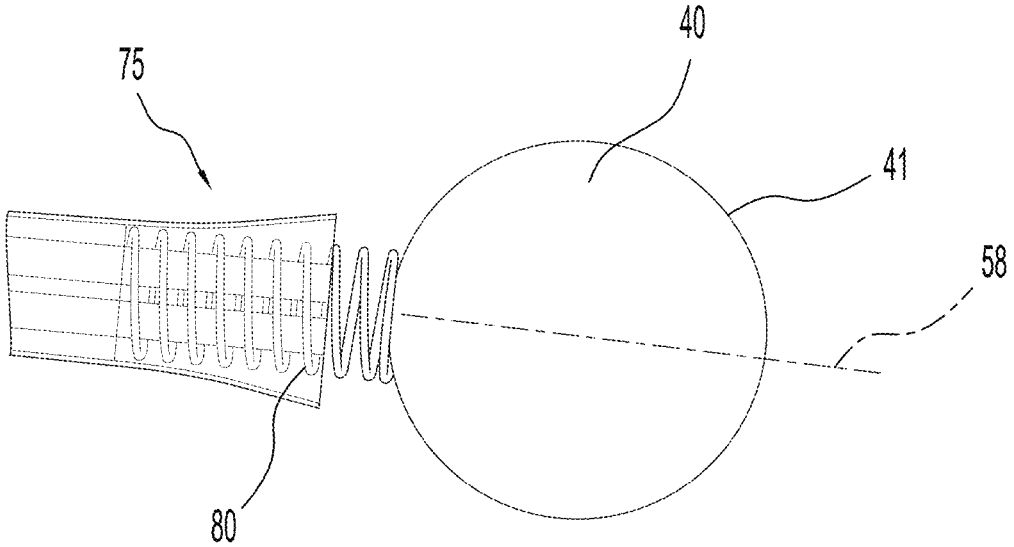
FIG. 30 depicts a side view of the ball contacting the ball capture spring with a plunger recessed in a body of the ball.
Figure 31:
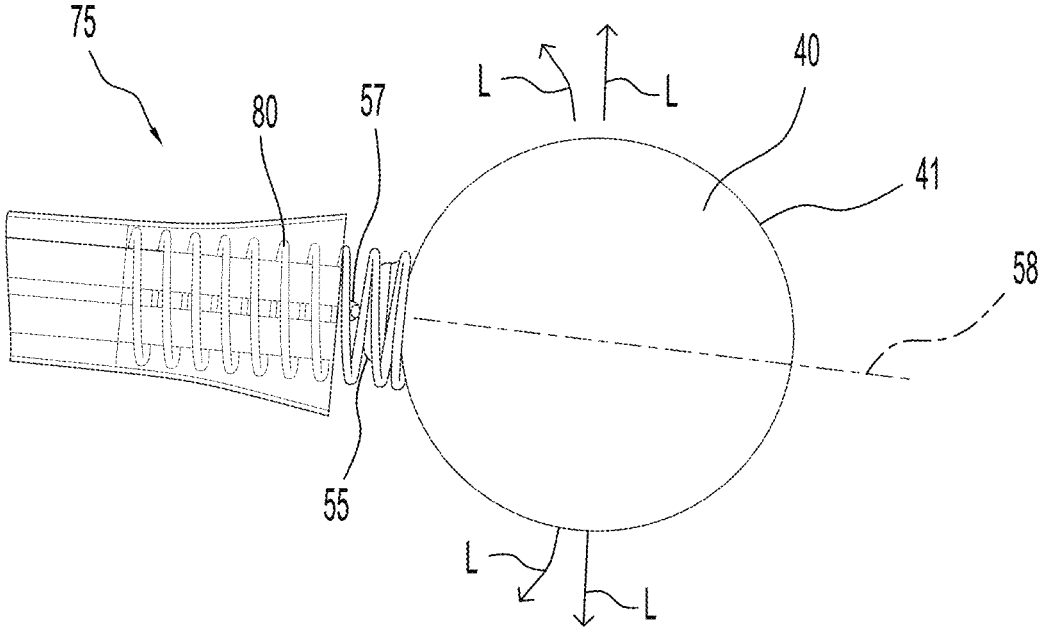
FIG. 31 depicts a side view like FIG. 30 with the plunger pulled out of the body and received in a void defined by the ball capture spring.

In operation, during retraction of the string 60 and when the ball 40 contacts the ball capture spring 80 (FIG. 30, see also described above and FIGS. 6-9), the tension in the string 60 increases and the tension forces act on the pin 51 via the string clip 57 such that the second plunger end 48 is axially moved out of the ball sleeve 59 (FIG. 31). The second plunger end 48 protruding from the ball sleeve 59 is received into the void defined by the ball capture spring 80, and thus, the second plunger end 48 stabilizes the ball 40 on the ball capture spring 80 as the tee assembly 70 is moved into the practice position (FIG. 2). For example, the outer surface of the second plunger end 48 contacts the inner surface of the ball capture spring 80 to thereby resist or prevent radial movement of the ball 40 while contacting the ball capture spring 80 (see arrows L depicts the possible radial movement of the ball 40).

Referring now to FIG. 29, an example sequence of operation for the internal components of the ball 40 described above is depicted. FIG. 29 includes four images (e.g., image 29A, image 29B, image 29C, image 29D) of the internal components of the ball 40 in different positions relative to each other. Image 29A depicts the outer surface 41 and the body 42 as semi-transparent thereby exposing the ball sleeve 59 and the plunger 44, and images 29B-29D exclude the outer surface 41 and the body 42 for clarity. Image 29B depicts the plunger 44 as semi-transparent to thereby expose the screw 45, the compression spring 46, the pin 51, and the bearings 52. In images 29A-29B, the compression spring 46 causes the second plunger end 48 to be biased into the depicted first position inside the ball 40 (note the outer limit line 61 of the ball 40). That is, the compression spring 46 applies a force in the first axial direction (arrow M) against the first plunger end 47. As such, the second plunger end 48 is normally recessed in the body 42.

Image 29C depicts the second plunger end 48 in the depicted second position in which the second plunger end 48 is pulled outside the body 42 when the ball 40 is on the ball capture spring 80 (see FIG. 31). The string 60 pulls the second plunger end 48 into the position depicted in image 29C. The second plunger end 48 is pulled outside the body 42 when the ball 40 contacts the ball capture spring 80 and the tension of the string 60 acts on the plunger 44 (see also FIGS. 30-31). That is, after the ball 40 contacts the ball capture spring 80 (FIG. 30), the tension on the string 60 increases and the increased tension acts on the second plunger end 48 in a second axial direction (arrow N). As such, the tension overcomes the forces exerted by the compression spring 46 on the first plunger end in the first axial direction (arrow M) and thus the compression spring 46 is compressed between the first plunger end 47 and the screw head 49. The second plunger end 48 protrudes out of the ball past the outer limit line 61 of the ball. The internal components of the ball 40 remain in the position depicted in image 29C as the tee assembly 70 is pivoted into the practice position (see FIGS. 8-9 and 2). As the pedal 110 is released, the cup 75 lifts the ball 40 off the ball capture spring 80 and the drive belt 136 of the return system 111 (described in detail below) is disengaged from the drum so that the tension in the string 60 is removed and the second plunger end 48 is moved in the first axial direction (arrow M) by the compression spring 46 back into the ball bore 43 of the body 42 as depicted by image 29D.

Figure 37:
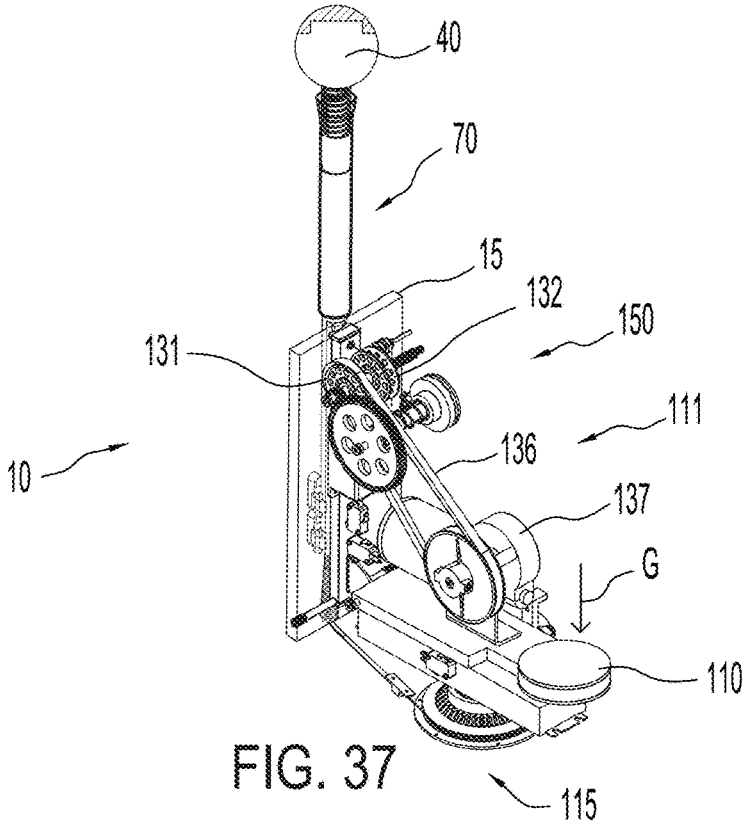
Figure 38:
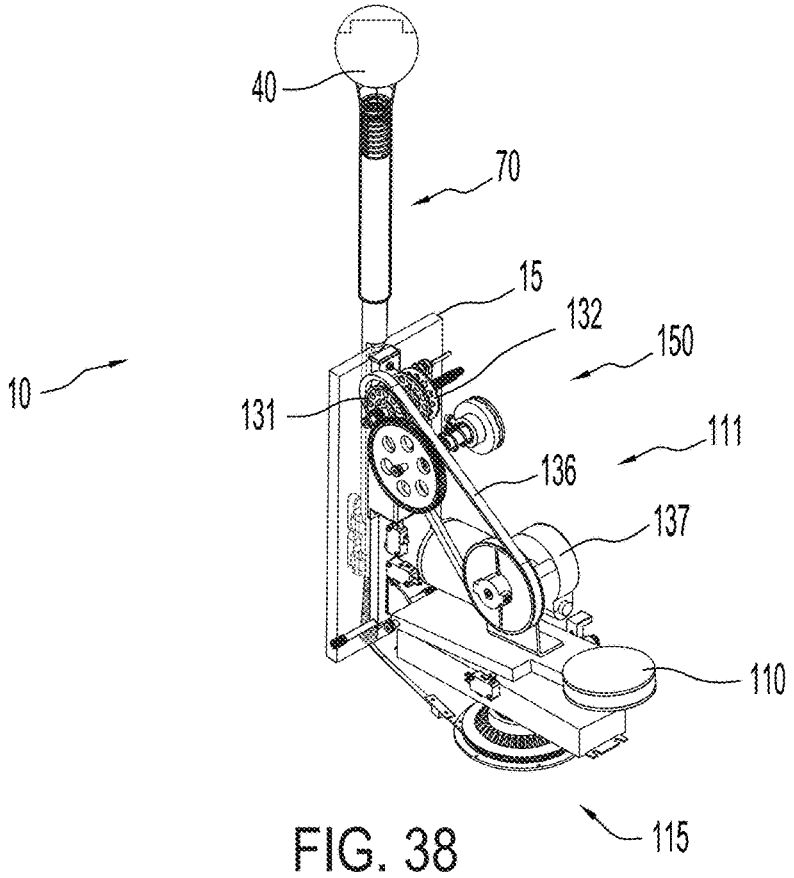
Figure 39:
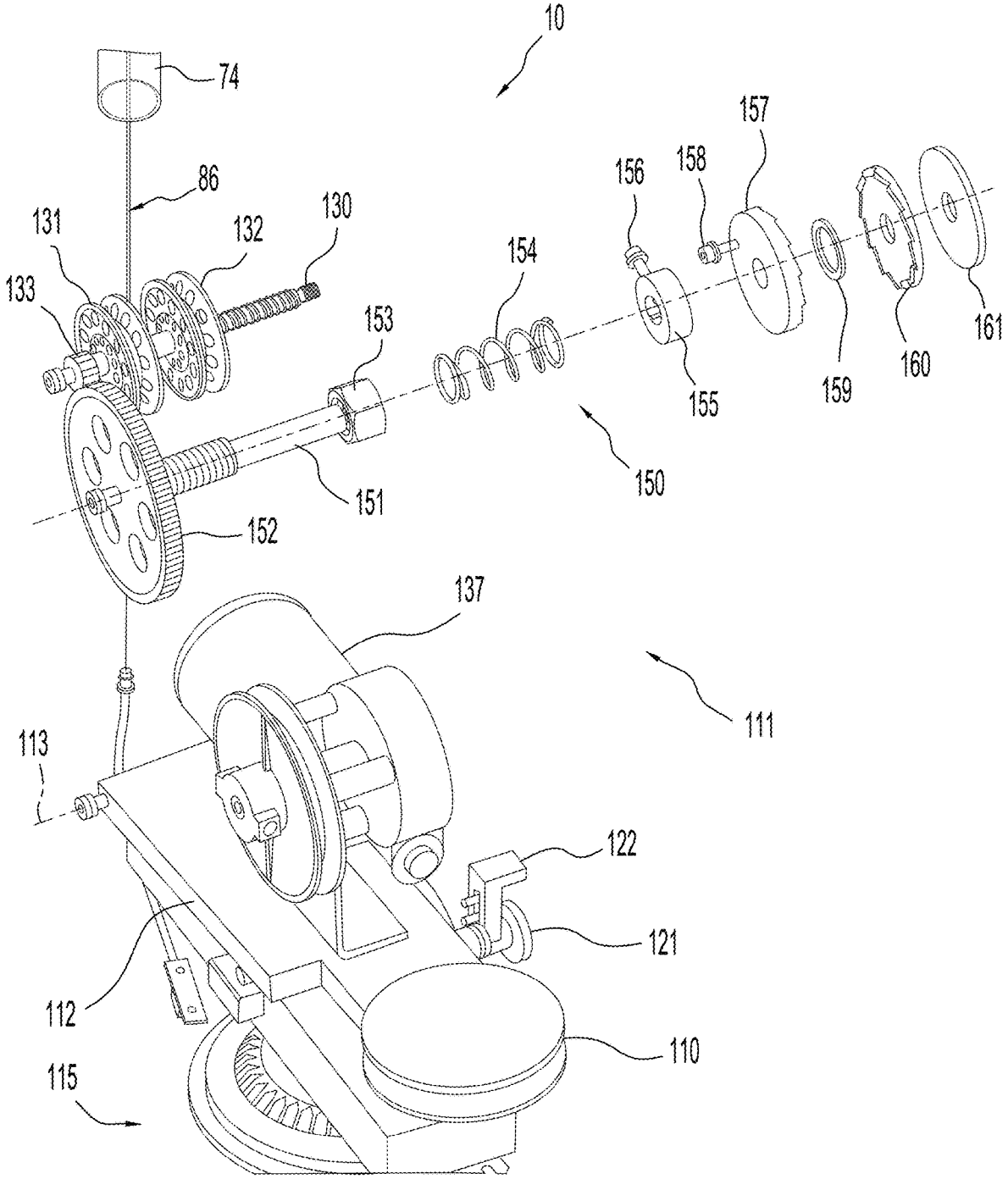
FIG. 39 is a partial exploded view of an example return system with delayed braking assembly of the present disclosure.

Referring now FIGS. 32-41, the return system 111 is depicted in greater detail. Specifically, FIGS. 32-38 depict an example operational sequence for hitting and returning the ball 40 to the practice position (see FIGS. 2 and 32) and FIG. 39 is an exploded view of the return system 111. Referring to FIG. 39, the return system 111 includes a first axle 130. A drum 131, a string spool 132, and a drum gear 133 are mounted on the first axle 130. A rotary speed sensor 134 (described further herein) senses a magnet 135 coupled to the string spool 132 (see FIG. 32). Note that in certain examples, the sensor 134 is a hall effect sensor and when the ball 40 is hit the sensor 134 senses movement of the magnet 135. The sensor 134 sends corresponding signals to a control system 140 and the rotational speed of the string spool 132 can be determined by the control system 140 which will correspond to the speed and/or velocity of the ball 40. The control system 140 may determine the speed and/or velocity based on a lookup table or algorithms stored on the memory of the controller 140. Note in certain examples, a hall-effect sensor 139 (FIG. 32) is configured to sense the magnet 135 and general output signal that is communicated to the control system 140. Based on the output signal(s), the control system 140 determines (e.g., via algorithms, lookup tables, the like) hit force on the ball 40 and/or hit distance of the ball 40.

Figure 54:
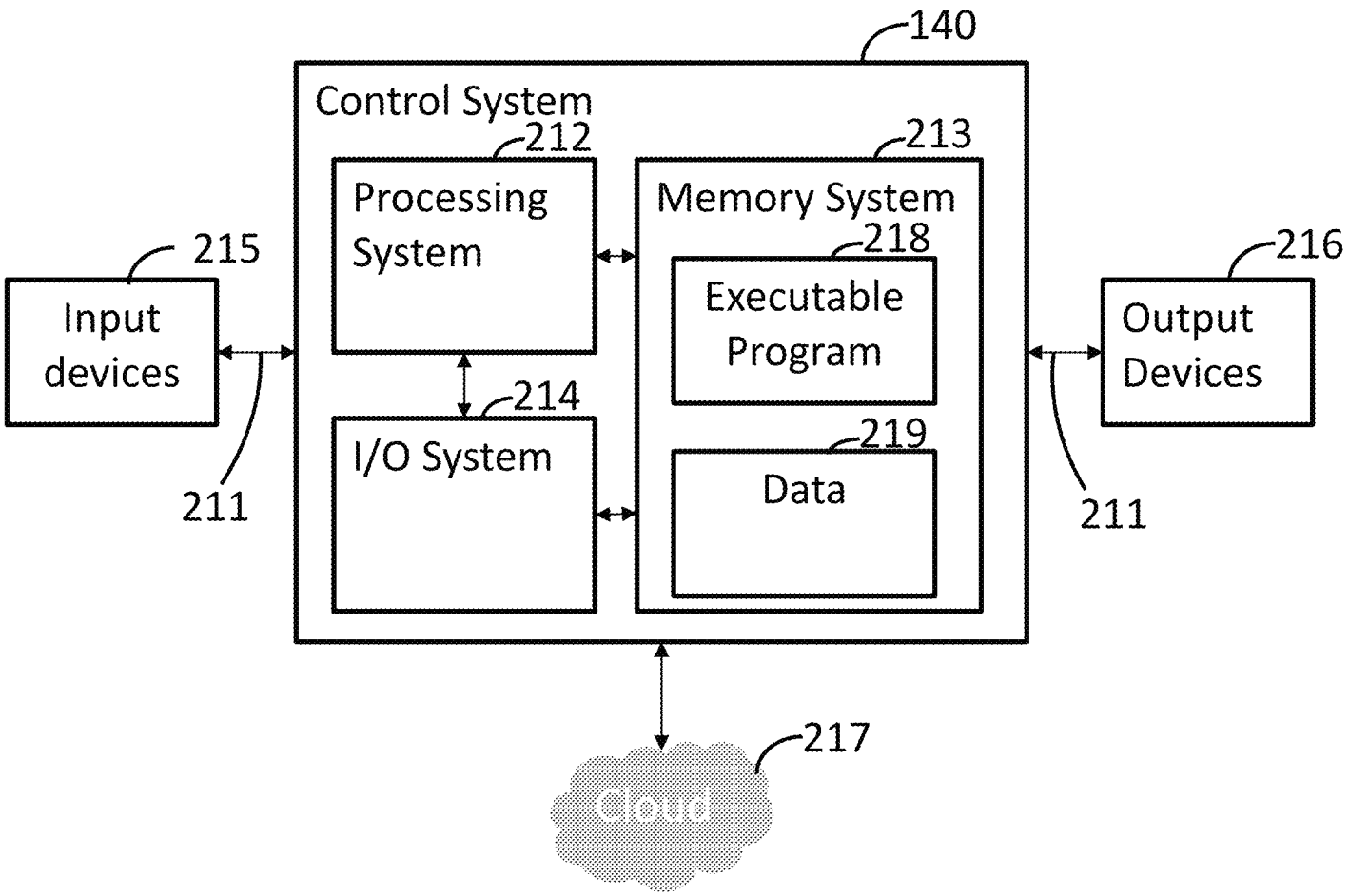
FIG. 54 is a schematic diagram of an example control system of the present disclosure.

Referring now to FIG. 54, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system or controller 140 communicates with each of the one or more components of the apparatus 10 via a communication link 211, which can be any wired or wireless link. The control system 140 is capable of receiving information and/or controlling one or more operational characteristics of the apparatus 10 and its various sub-systems by sending and receiving control signals via the communication links 211. In one example, the communication link 211 is a controller area network (CAN) bus; however, other types of links could be used. It will be recognized that the extent of connections and the communication links 211 may in fact be one or more shared connections, or links, among some or all of the components in the apparatus 10. Moreover, the communication link 211 lines are meant only to demonstrate that the various control elements are capable of communicating with one another, and do not represent actual wiring connections between the various elements, nor do they represent the only paths of communication between the elements. Additionally, the apparatus 10 may incorporate various types of communication devices and systems, and thus the illustrated communication links 211 may in fact represent various different types of wireless and/or wired data communication systems.

The control system 140 may be a computing system that includes a processing system 212, memory system 213, and input/output (I/O) system 214 for communicating with other devices, such as input devices 215 (e.g., magnet sensor) and output devices 216 (e.g., user interface display touchscreen), either of which may also or alternatively be stored in a cloud 217. The processing system 212 loads and executes an executable program 218 from the memory system 213, accesses data 219 stored within the memory system 2123, and directs the apparatus 10 to operate as described in further detail below.

The processing system 212 may be implemented as a single microprocessor or other circuitry, or be distributed across multiple processing devices or sub-systems that cooperate to execute the executable program 218 from the memory system 213. Non-limiting examples of the processing system include general purpose central processing units, application specific processors, and logic devices.

The memory system 213 may comprise any storage media readable by the processing system 212 and capable of storing the executable program 218 and/or data 219. The memory system 213 may be implemented as a single storage device, or be distributed across multiple storage devices or sub-systems that cooperate to store computer readable instructions, data structures, program modules, or other data. The memory system 213 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Figure 55:
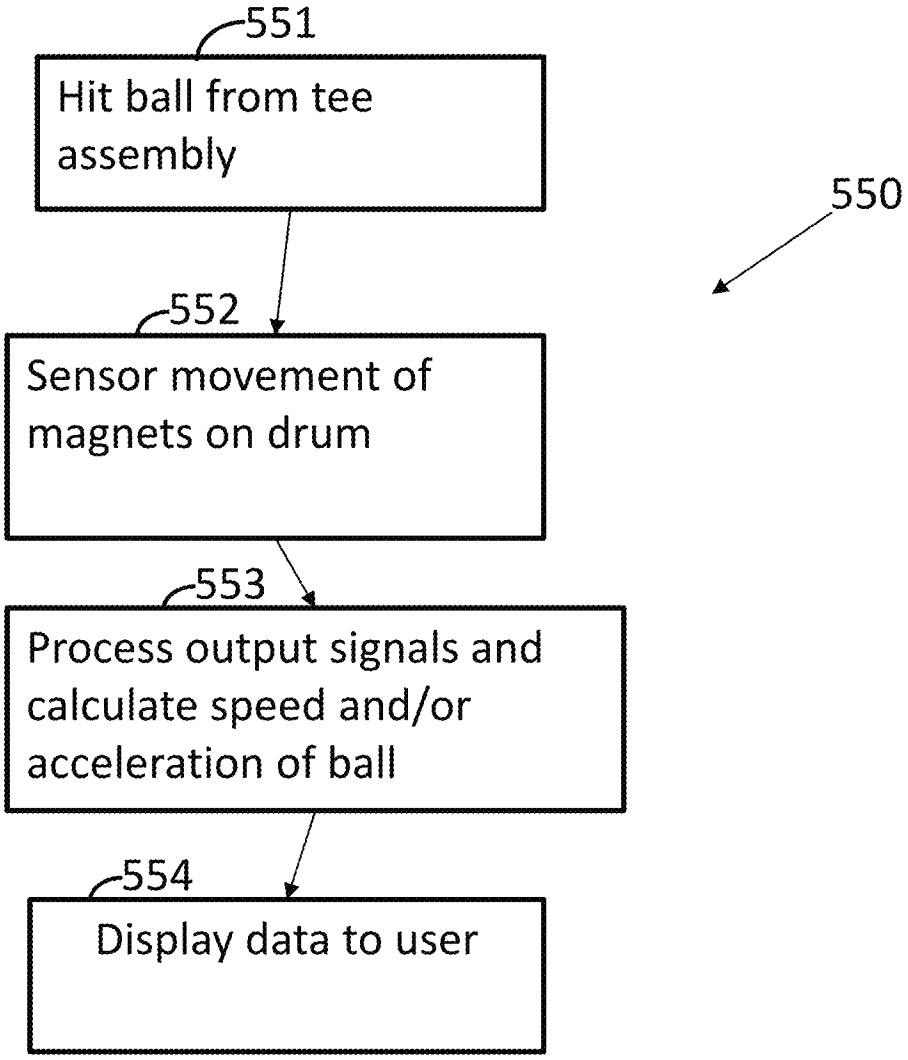
FIG. 55 is an example process flow of the present disclosure.

An example method or process flow 550 (FIG. 55) for determining travel distance of the ball 40 hit off the tee is described herein below. The process flow begins by hitting the ball 40 from the tee assembly 70 such that the string 60 unwinds from the drum 131 and thereby causing the drum 131 to rotate, at 551. At 552 one or more magnets are coupled to the drum 131 such that the drum 131 rotates the magnets, and the magnets pass a stationary sensor (e.g., Hall Effect Sensor) that is configured to sense the magnets and output signals as each magnet is sensed. The output signals are communicated to the control system 140 and the processing system 212 measures and/or compares the length of time between each successive signal from the sensor (e.g., the processing system 212 determines the "rise and fall" of each sensor signal that occurs once for each predetermined distance that the ball 40 travels away from the tee assembly 70). The processing system 212, at 553, further calculates with algorithms stored on the memory system 213 the speed of the ball 40 (e.g., miles per hour) and/or acceleration (e.g., miles per second squared). Note that in certain examples the ball 40 travels unrestrained for an initial distance away from the tee assembly 70 (e.g., 4.0 feet) before the tee assembly 70 applies a braking force on the drum 131 and/or the string 60 (e.g., a delayed braking function). At 554, the control system 140 sends signals to a user interface device (e.g., touch screen, mobile smartphone) corresponds to speed and/or acceleration such that the speed and/or acceleration of the ball 40 is displayed to the user.

The example process flow noted above can include other features and/or steps such as the features/steps described hereinbelow. In certain examples, the processing system 212 uses predetermined imputed apparatus constants, such as ball mass and string corrections, to account for inherent drag within the apparatus 10. In certain examples, the processing system 212 uses algorithms stored on the memory system 213 to determine hit force, energy, and/or power imparted on the ball 40. In certain examples, the processing system 212 data output from the control system 140 is routed to the user display (not depicted; e.g., touchscreen display) mounted on the top access panel for the user's review. The user display can show hit force, power, max ball speed, and/or projected distance traveled based on an optimal 45.0 degree hit trajectory. In certain examples, when the pedal 110 is activated to initiate retraction of the ball 40, power is cut to the control system 140. Once the tee assembly 70 is in the stationary position (FIG. 37) and the pedal 110 is disengaged, the control system 140 resets and waits for the next hit of the ball 40. In certain examples, performance data for every hit is recorded in a data log on the memory system 213 and the data can be accessed by the user via a downloadable app loaded on a smartphone and Bluetooth or a connection port on the control system 140.

A belt 136 encircles the drum 131, and coupled to a motor 137 configured to drive the belt 136. The motor 137 is coupled to the platform 112, and therefore, as the pedal 110 is depressed and released the motor 137 will pivot with the platform 112. Pivoting of the platform 112 further causes the belt 136 to move with the motor 137 such that when the pedal 110 is depressed the belt 136 is pulled into tight engagement with the drum 131. As such, when the motor 137 is actuated the motor 137 drives the belt 136 such that the string spool 132 is rotated and the string 60 is retracted and wrapped around the string spool 132. Note that the motor 137 is actuated when the pedal is depressed and a switch (e.g., limit switch) is triggered. Note in certain examples, the limit switch is positioned under the platform 112.

Figure 40:
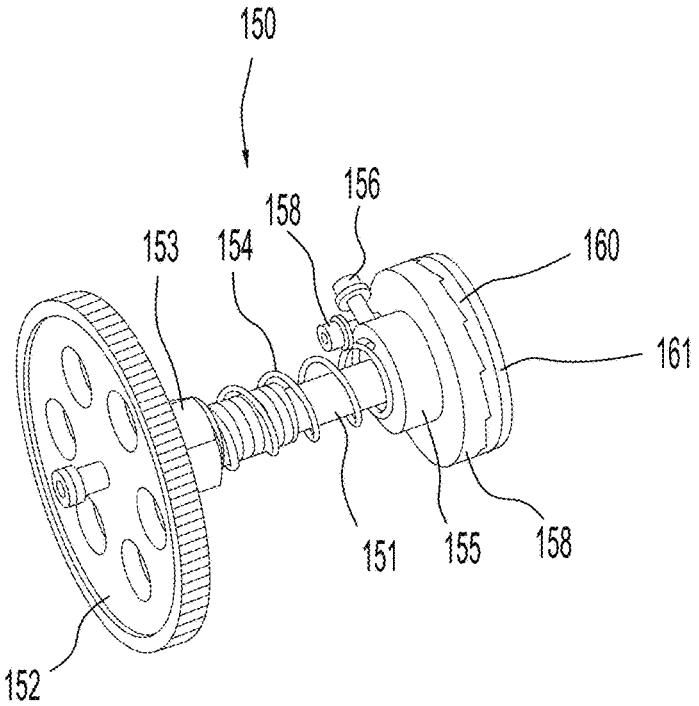
FIG. 40 is a perspective view of an example delayed braking assembly of the present disclosure.
Figure 41:
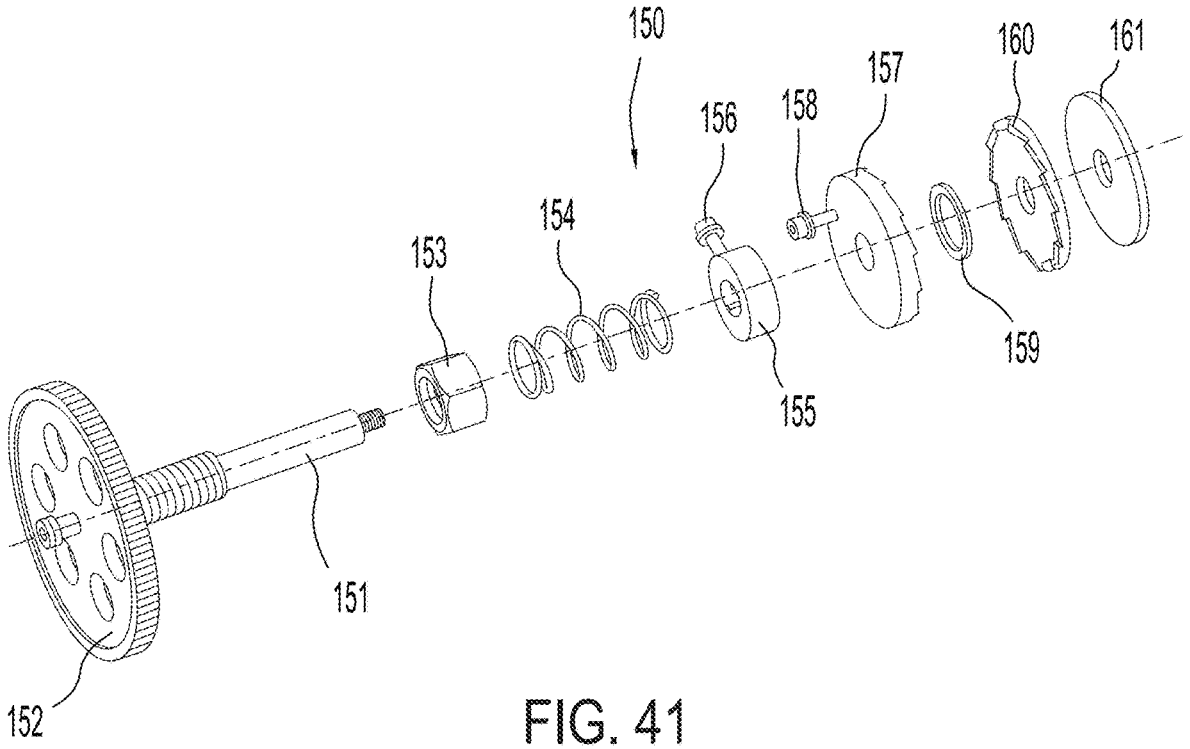
FIG. 41 is an exploded view of the delayed braking assembly of FIG. 40.

The drum gear 133 meshes with a delayed braking assembly 150 (described further hereinbelow). The delayed braking assembly 150 has a second axle 151. A slotted gear drive 152, an adjusting nut 153, a spring 154, a keyed drive carriage 155 with radial drive post 156, a brake clutch 157 with an offset axially oriented latch post 158, a brake clutch dampener 159, a brake clutch plate 160, and a brake pad 161 are coupled to the second axle 151. FIGS. 40-41 also depict the delayed braking assembly 150.

Figure 32:
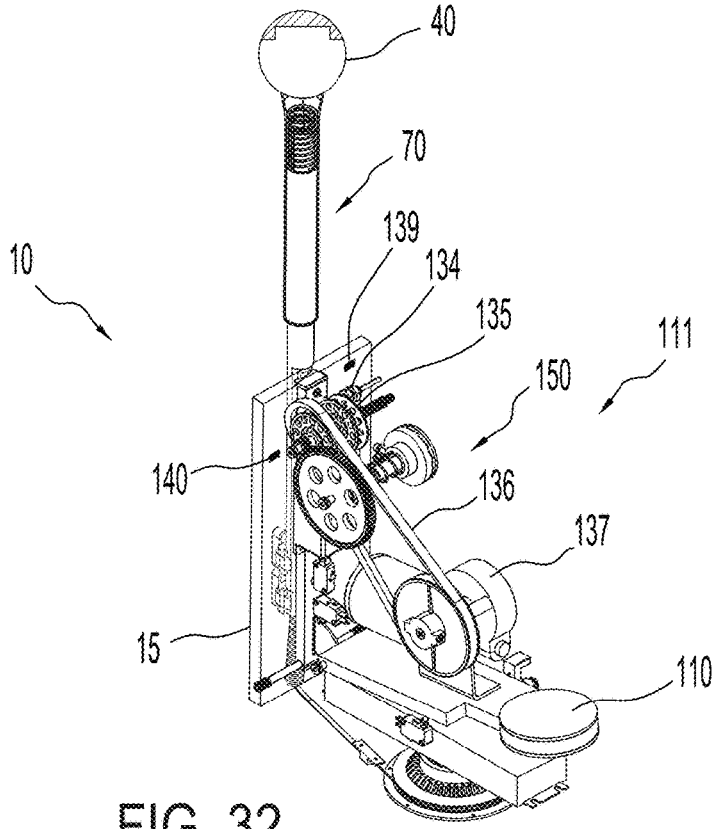
FIGS. 32-38 are various perspective views of an example apparatus with the return system exposed to thereby depict an example operational sequence of returning the ball to the practice position.
Figure 33:
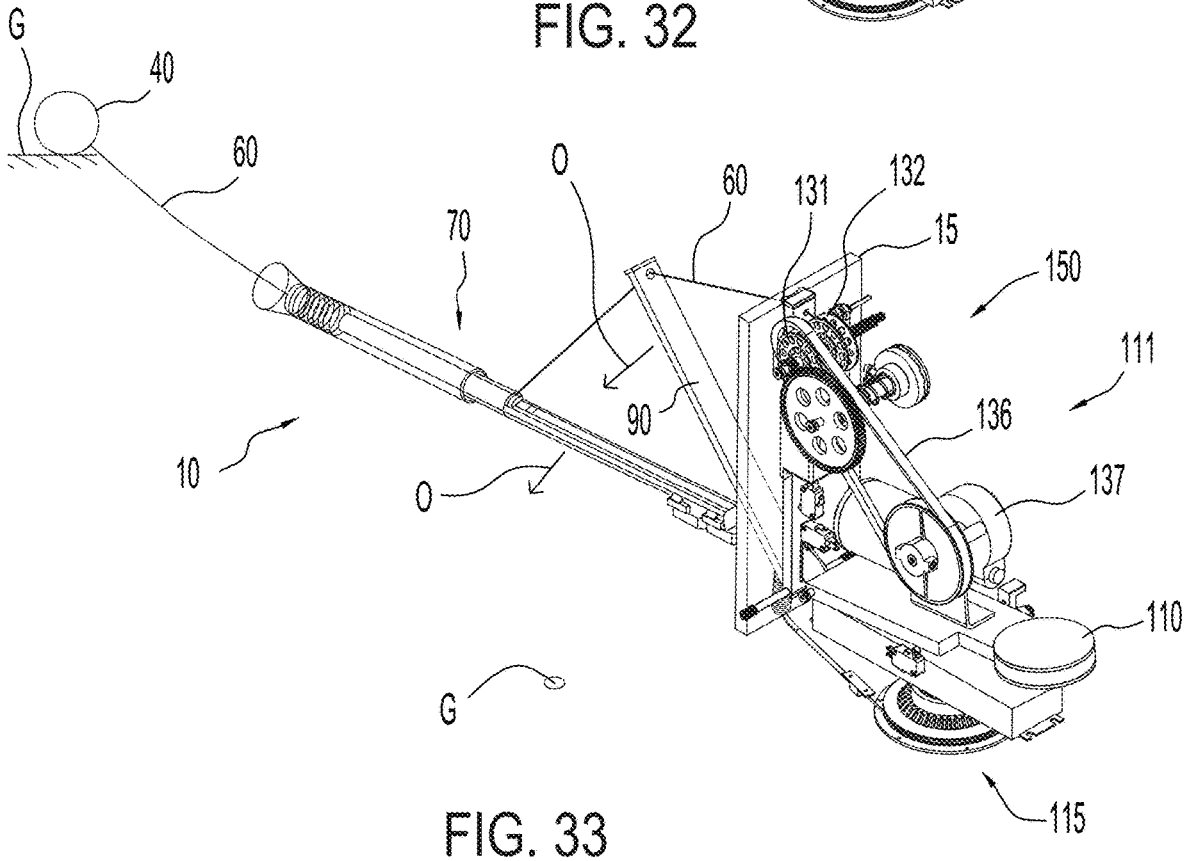
Figure 42:
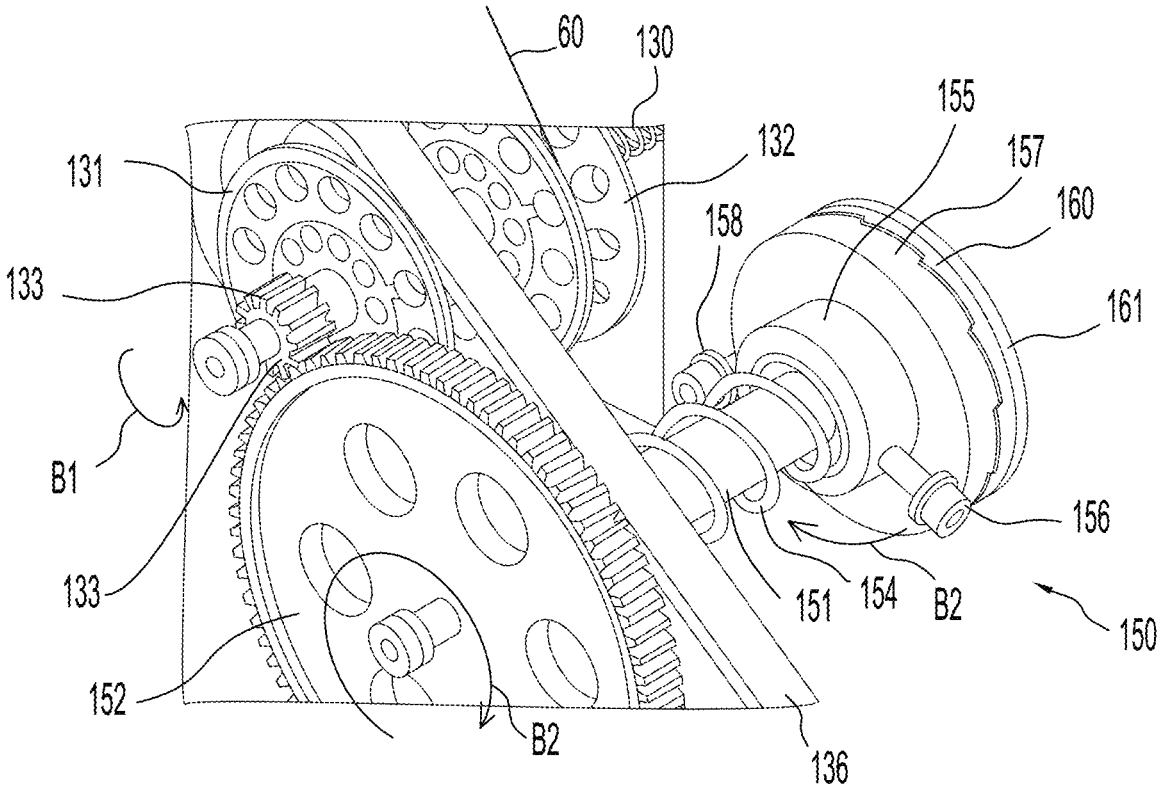
FIGS. 42-48 are various partial perspective views of an example return system depicting example operational sequences of a delayed braking assembly.
Figure 43:
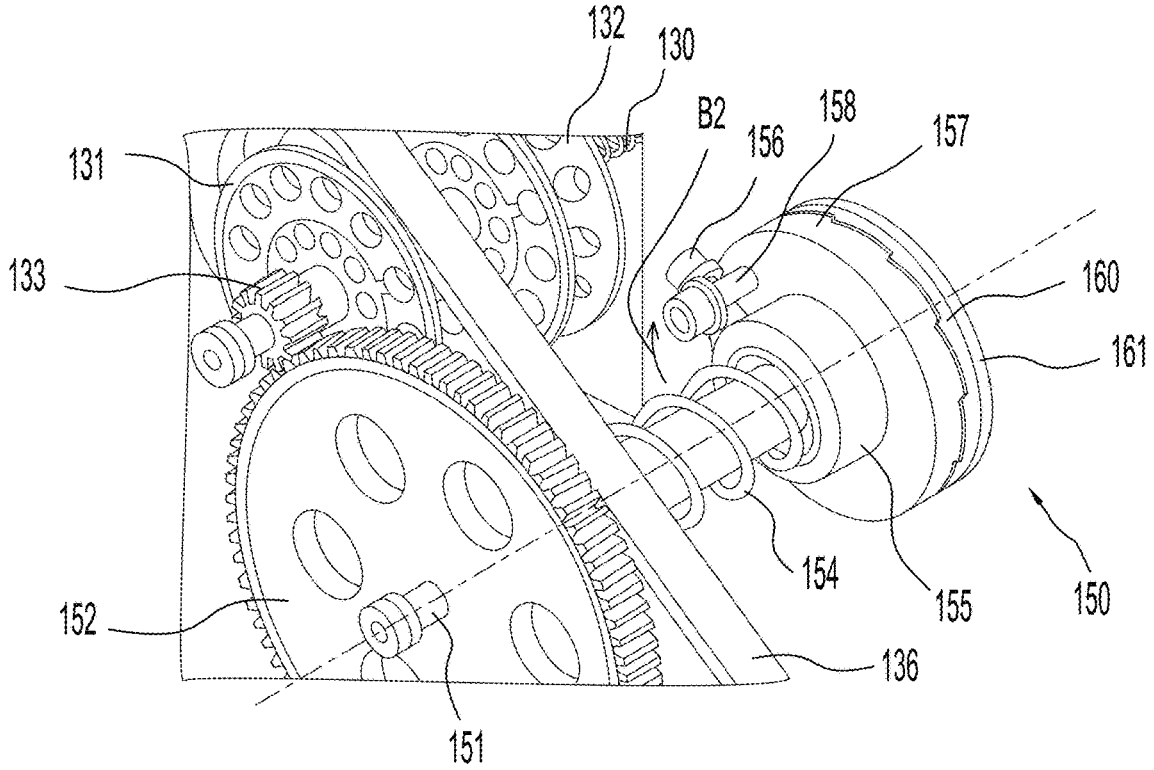

Referring back to FIGS. 32-38, an example operational sequence is depicted. FIG. 32 depicts the apparatus 10 in the practice position with the ball 40 on top of the tee assembly 70 (see also FIG. 2). The user then hits the ball 40 off the tee assembly and the string 60 follows the ball 40 as depicted in FIG. 33. The tension on the string 60 caused by movement of the ball 40 away from the tee assembly 70 acts on the tee assembly 70 and the arm 90 and thereby pivots these components toward the ground (see arrow O). FIG. 42 the string 60 unwinding from the string spool 132 also rotates the drum gear 133 (see rotation arrow B1) which rotates the gear drive 152 in the opposite direction (see rotation arrow B2). As such, the gear drive 152 and the keyed drive carriage 155 rotate freely (see rotation arrow B2) until the radial drive post 156 contacts the latch post 158 (as depicted in FIG. 43). Note that the belt 136 is not tensioned around and/or is not preventing rotation of the drum 131 and the drum 131 rotates. In certain examples, the belt 136 may be in contact with the drum 131 but is not applying substantial forces to the drum 131 to slow the rotation of the drum 131.

Figure 44:
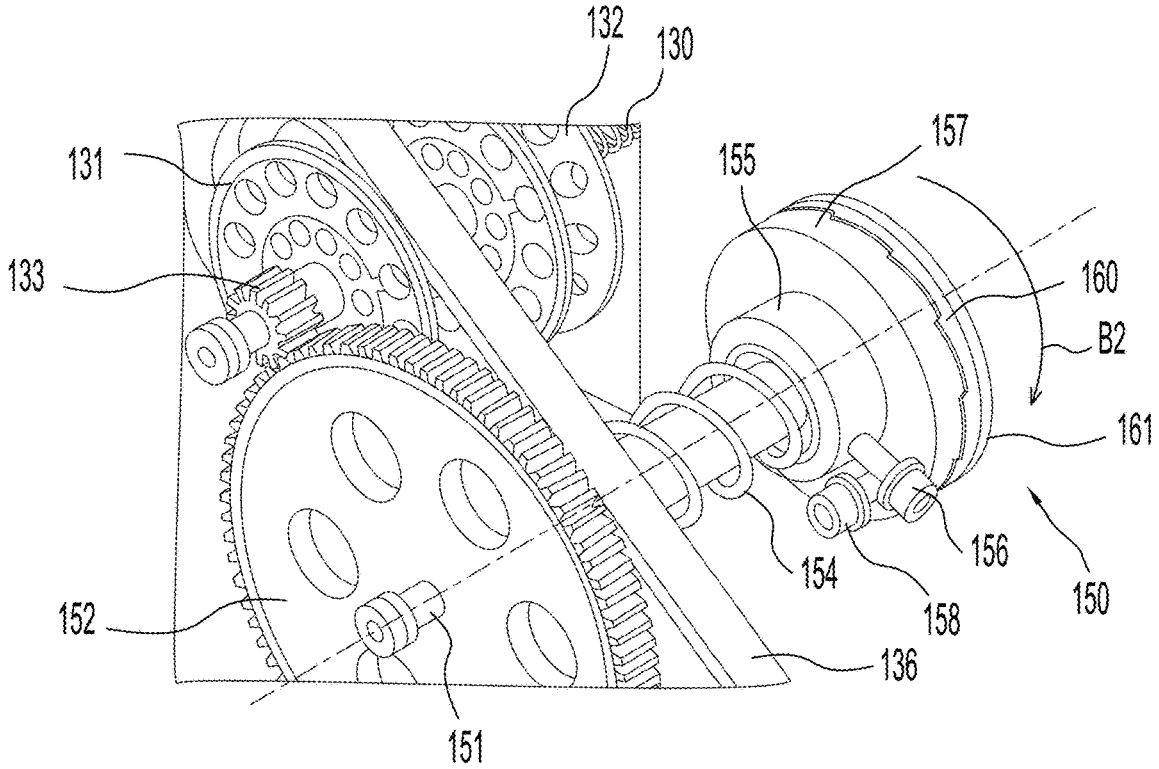

Continued rotation (see rotation arrow B2 on FIG. 43-44) as the string 60 continues to unwind from the string spool 132 thereby causing the brake clutch 157 to rotate with the drive carriage 155. Rotation of the brake clutch 157 thereby begins rotating the brake clutch plate 160 and the brake pad 161. Friction between the brake pad 161 and the brake clutch plate 160 slows rotation of the components and further slows rotation of the string spool 132 as the string 60 is unwinding therefrom. This causes tension to be applied to the string 60 to reduce the speed and/or the velocity of the string 60 and thereby slow the speed and/or velocity of the ball 40. Accordingly, the delayed braking assembly 150 slows travel of the ball 40 and the string 60 after a period of time that the ball 40 and the string freely move away from the tee assembly 70. Slowing the speed and/or the velocity of the ball 40 can help the user keep the ball 40 within a designated space (e.g., within a backyard) and/or prevent the ball 40 from damaging property (e.g., the ball 40 is stopped before reaching a window of a building). Note that the adjusting nut 153 and the spring 154 permit the user to adjust the braking force being applied by the brake clutch plate 160 and the brake pad 161. For example, the nut 153 is moved axially toward the brake clutch plate 160 and the brake pad 161 thereby compressing the spring 154 which pushes on the brake clutch plate 160 and the brake pad 161. This force increases the braking forces applied when the ball 40 is hit as described above.

Figure 34:
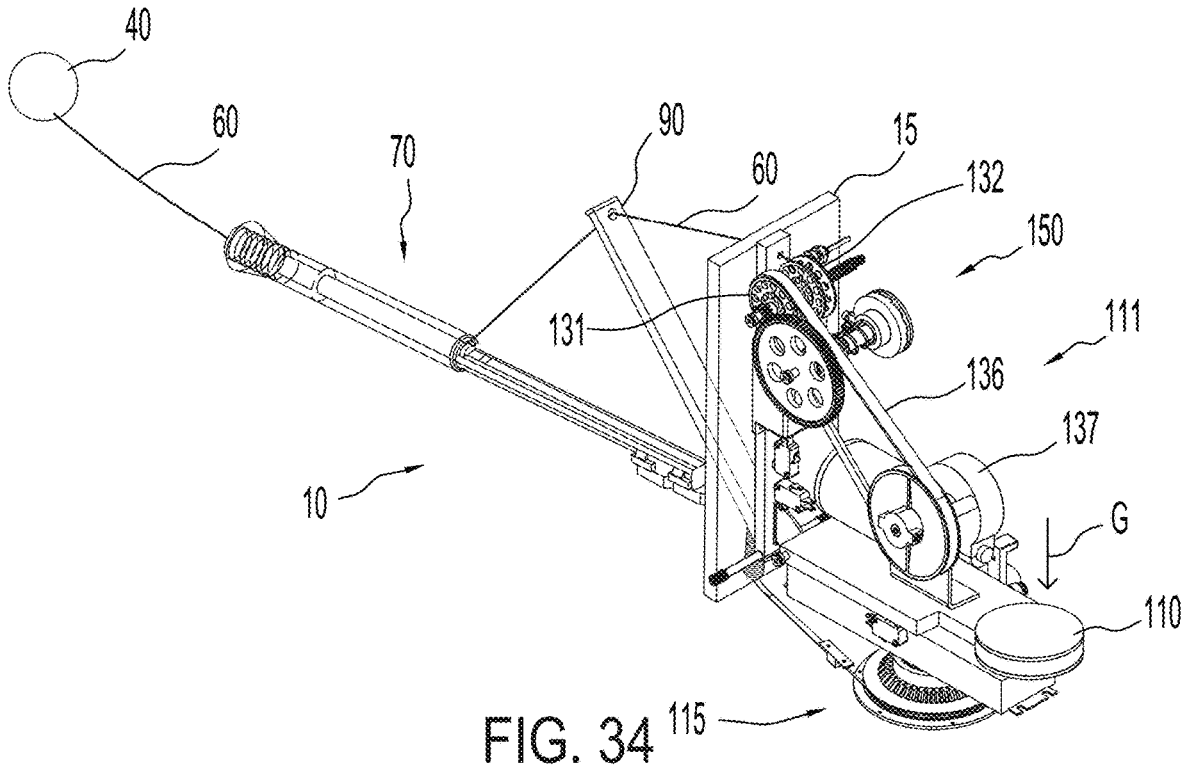
Figure 45:
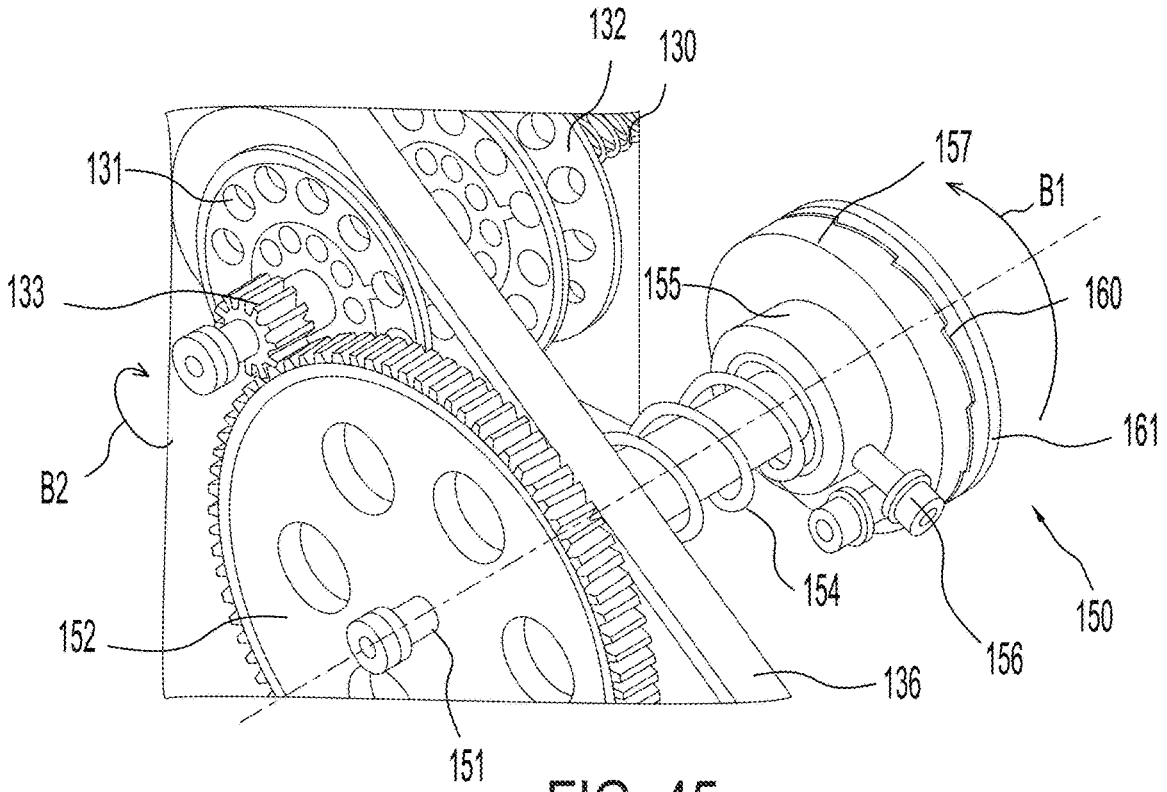
Figure 46:
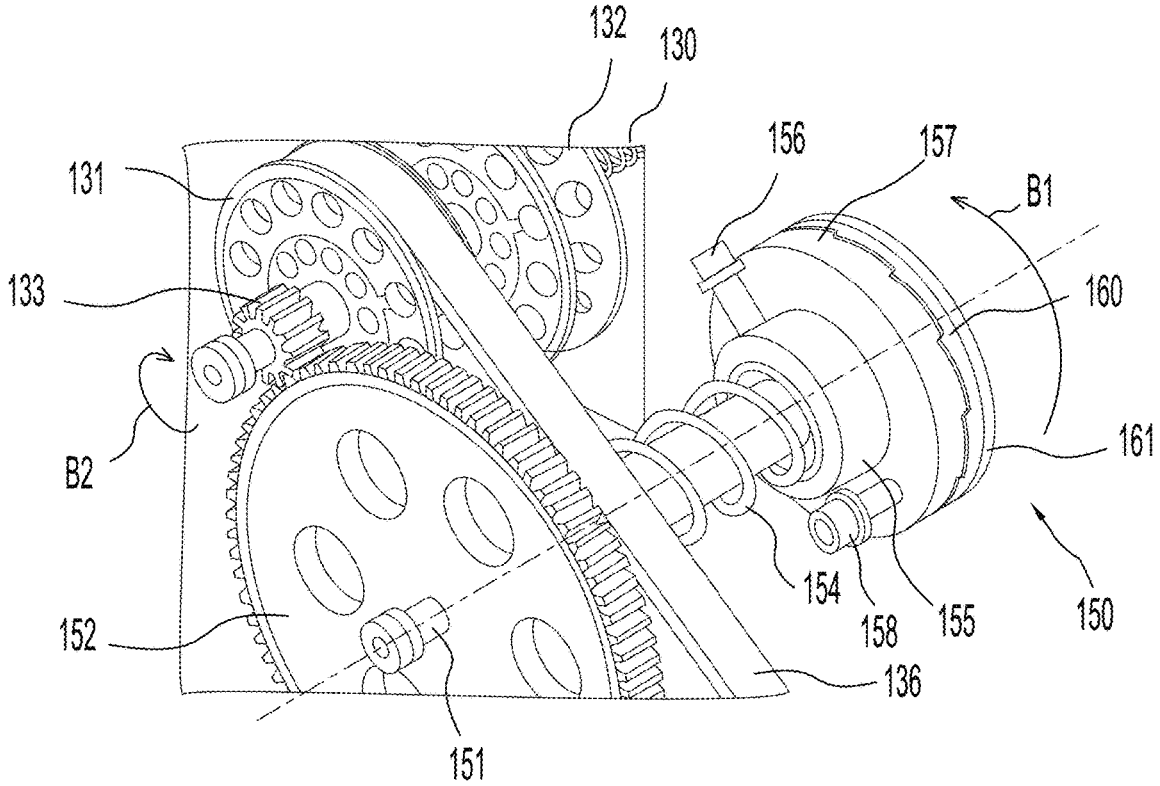
Figure 47:
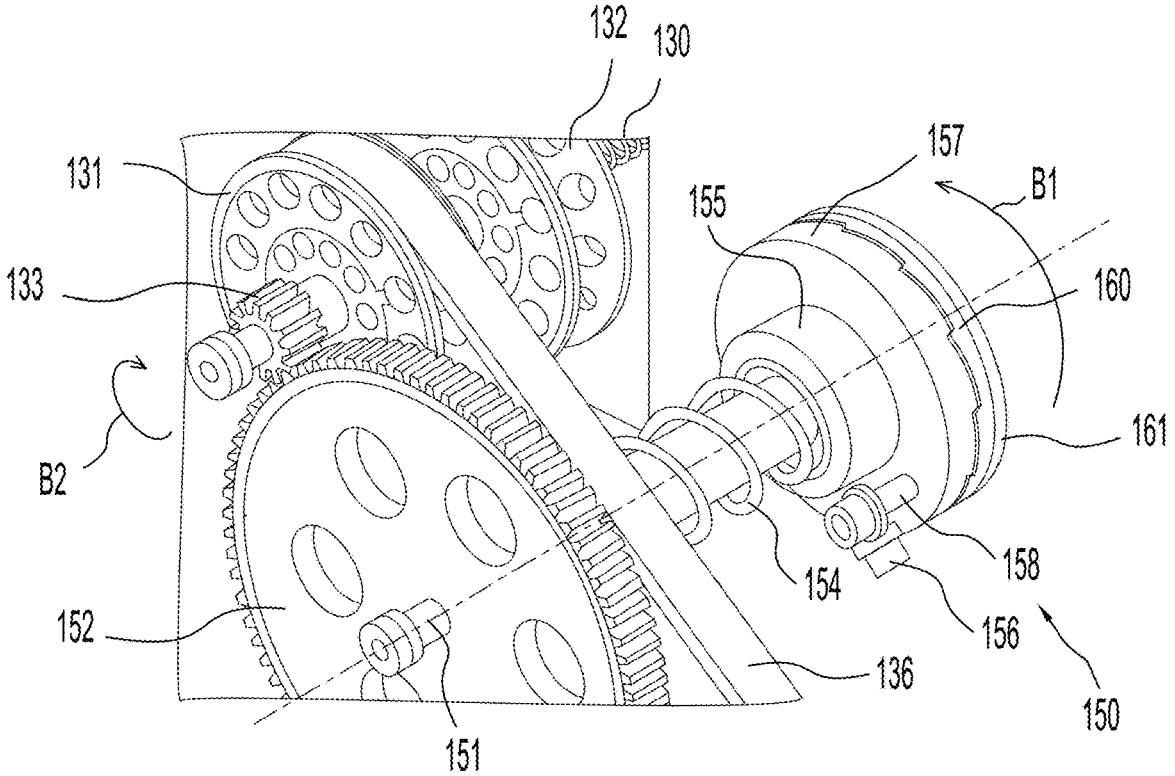
Figure 48:
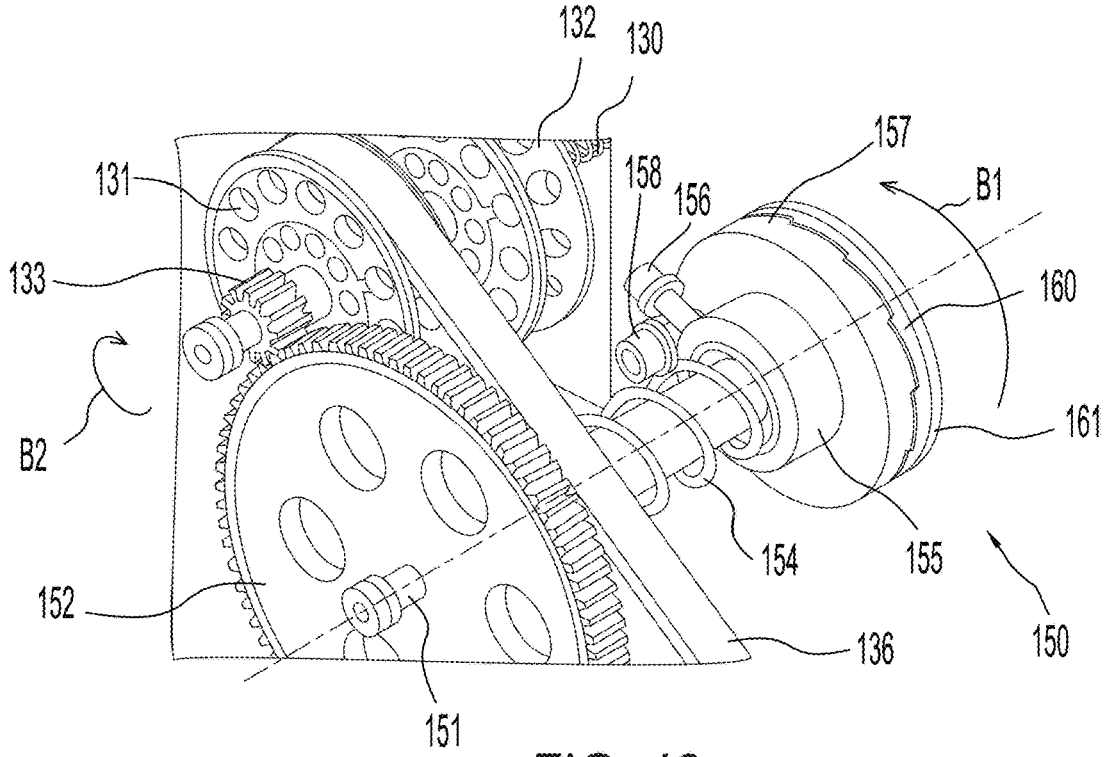
Figure 49:
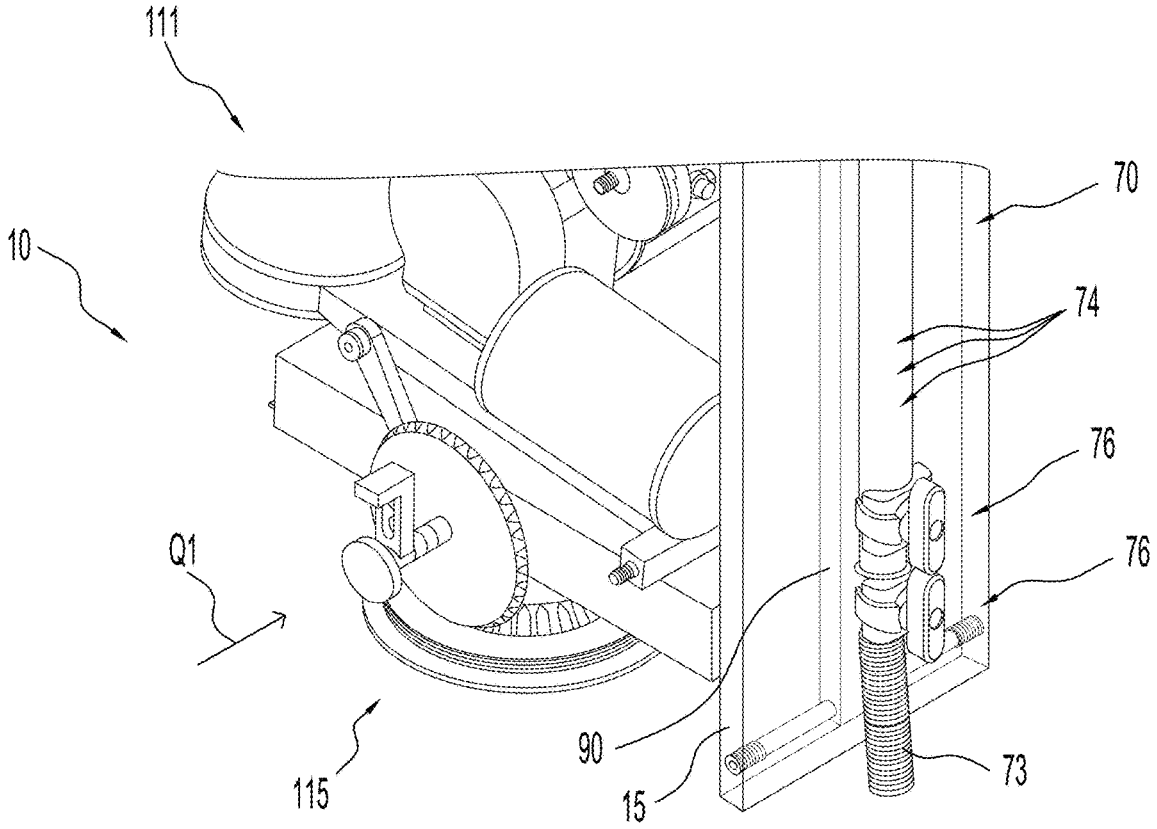
FIG. 49 is a partial perspective view of an example return system of the present disclosure with a drive gear engaging a spool gear.
Figure 50:
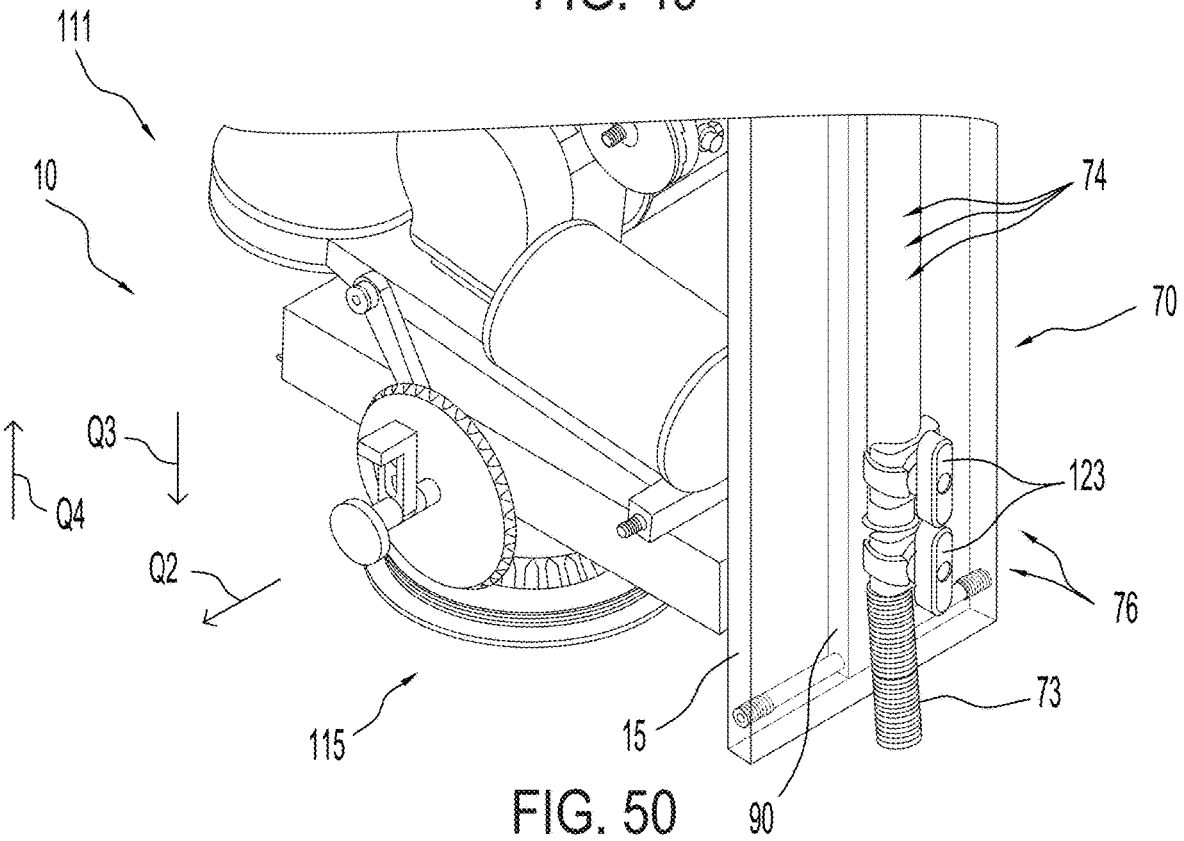
FIG. 50 is a view like FIG. 49 with the drive gear disengaged from the spool gear.
Figure 51:
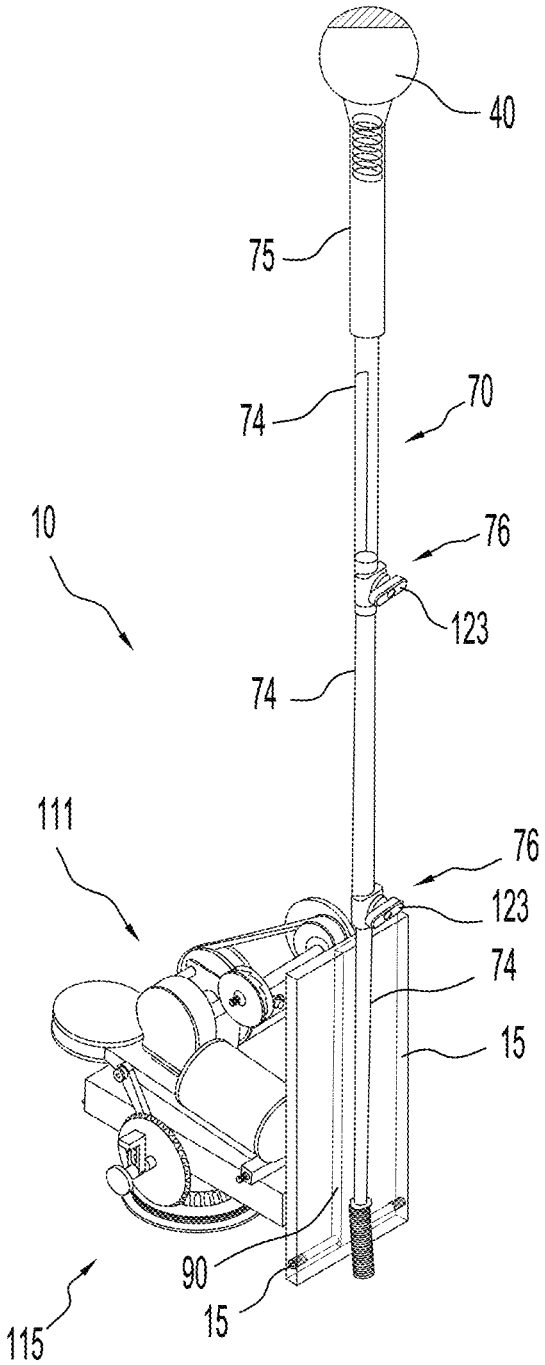
FIGS. 51-52 are perspective views of an example apparatus depicting movement and locking of tee tubes relative to each other.

Turning back to FIG. 33, the ball 40 has come to rest on the ground G. The user then depresses the pedal 110 as depicted in FIG. 34 causing the platform 112 to pivot and the belt 136 to engage the drum 131. The motor 137 is activated to drive the belt 136 which rotates drum 131. As such, the string spool 132 is rotated, the string 60 is wound around the string spool 132, and the ball 40 is pulled into contact with the ball capture spring 80 (as described above). As the drum 131 rotates (see rotation B2 on FIG. 45), the brake clutch 157 and the keyed drive carriage 155 freely rotate (see rotation B1 on FIG. 46) before the radial drive post 156 contacts the opposite side of the latch post 158 (see FIG. 47). Thereafter, these components rotate together (as depicted in FIG. 48) until the ball 40 is fully retracted and the tee assembly 70 is in the vertically orientated position (see FIG. 20). Note that in certain examples, the brake pad 161 and the brake clutch plate 160 have ratcheted or toothed interfaces between them such that the brake pad 161 and the brake clutch plate 160 slip past one another during rotation B1 depicted in FIGS. 45-46. These features prevent excessive wear on the brake pad 161, the motor 137, the belt 136, and the drum 131.

Figure 35:
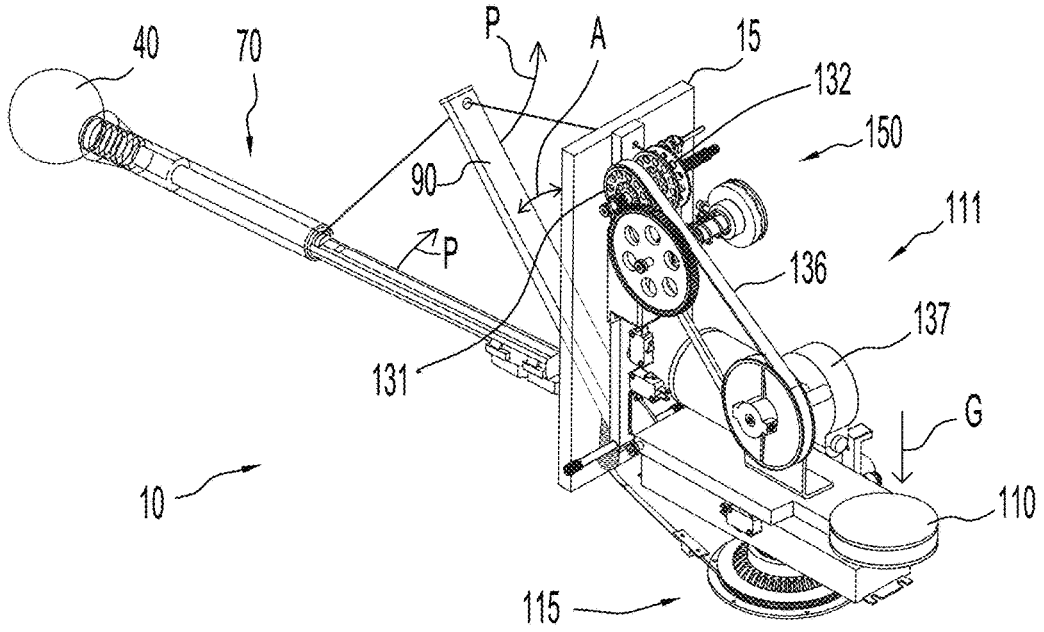
Figure 36:
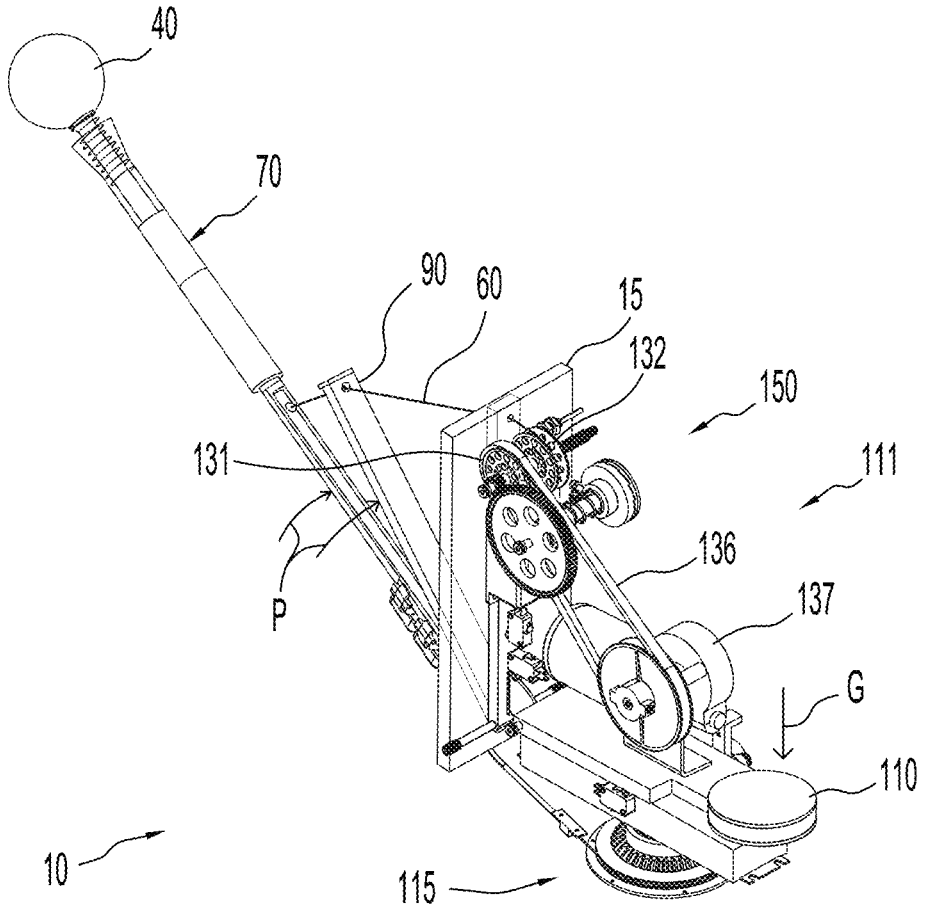

Referring to FIG. 35, the string 60 continues to be wound around the string spool 132 as noted above, and the ball 40 contacts the ball capture spring 80 (see also FIGS. 30-31). The tension in the string increases (as described above). The string 60 acts on the tee assembly 70 and the arm 90 to thereby cause the tee assembly 70 and the arm 90 to pivot vertically upwardly (see arrow P on FIGS. 35-36) as depicted in FIGS. 35-36. In certain examples, the arm 90 includes an air piston to slow vertical ascent of the arm 90 and the tee assembly 70 and further prevent transverse (see arrow T) movement of the tee assembly 70. Note that in certain examples, the arm 90 deploys to a 45.0 degree angle relative to the housing 15 (see angle A on FIG. 35)

The arm 90 is configured to prevent transverse movement (see arrow T on FIG. 1) of the tee assembly 70. The arm 90 also includes a fin 91 (FIG. 19) near the pivot point between the arm 90 and the housing 15 or base 12. The fin 91 is a curved member that depresses a switch 92 when the arm 90 and the tee assembly 70 pivot toward the housing 15 (see arrow P on FIG. 35). As the switch 92 is depressed, the switch will send signals to a controller (not depicted) which will operate a motor 137 (described below) to thereby decrease the speed of winding the string 60 and decrease the speed of the tee assembly 70 and the arm 90 approaching the housing 15.

FIG. 37 depicts the tee assembly 70 in the stationary position (see also FIG. 20). The user then releases the pedal 110, as depicted in FIG. 38, and the cup 75 lifts the ball 40 off the ball capture spring 80 (as described above). The platform 112 pivots such that the motor 137 limit switch is deactivated and the belt 136 no longer tensions the drum 131. Note that in certain examples when the tee assembly 70 is orientated generally vertical (see stationary position (FIG. 37) and/or practice position (FIG. 38)) the power kill switch (not depicted) is activated and cuts power to the motor 137. The power kill switch prevents damage caused by possible excessive tensioning on the belt 136 and/or the string 60.

Referring now to FIGS. 49-53, the adjustable length of the tee assembly 70 (note above) is described in greater detail. A pull knob 121 is spring-biased in a first direction Q1 to keep drive gear 120 in engagement with the spool gear 119. The user pulls the pull knob 121 in the second direction (see arrow Q2) against the spring force such that the drive gear 120 disengages from the spool gear 119. A latch 122 will drop under force of gravity (see arrow Q3) to prevent the pull knob 121 from pushing on the drive gear 120 into engagement with the spool gear 119. As such, the spool gear 119 can freely rotate such that a length of cable 86 (see FIG. 25) can be pulled away from the lift assembly 115. The user then operates one or more clamps 76 unlocking the position of the tee tubes 74 relative to each other. Specifically, the operator rotates a handle 123 of the clamp in first direction to unlock the tee tubes 74. The user then axially slides the tee tubes 74 relative to each other to customize the length of the tee assembly 70 (see FIG. 51). Note that the cable 86 and the string 60 will move with the tee assembly 70 as the length of the tee assembly 70 is adjusted. Further note that the constant force spring 118 will maintain a nominal torque on the spool gear 119 and thus tension in the cable 86 so that the spool gear 119 will wind the cable 86 when the length of the tee assembly 70 is decreased.

Figure 52:
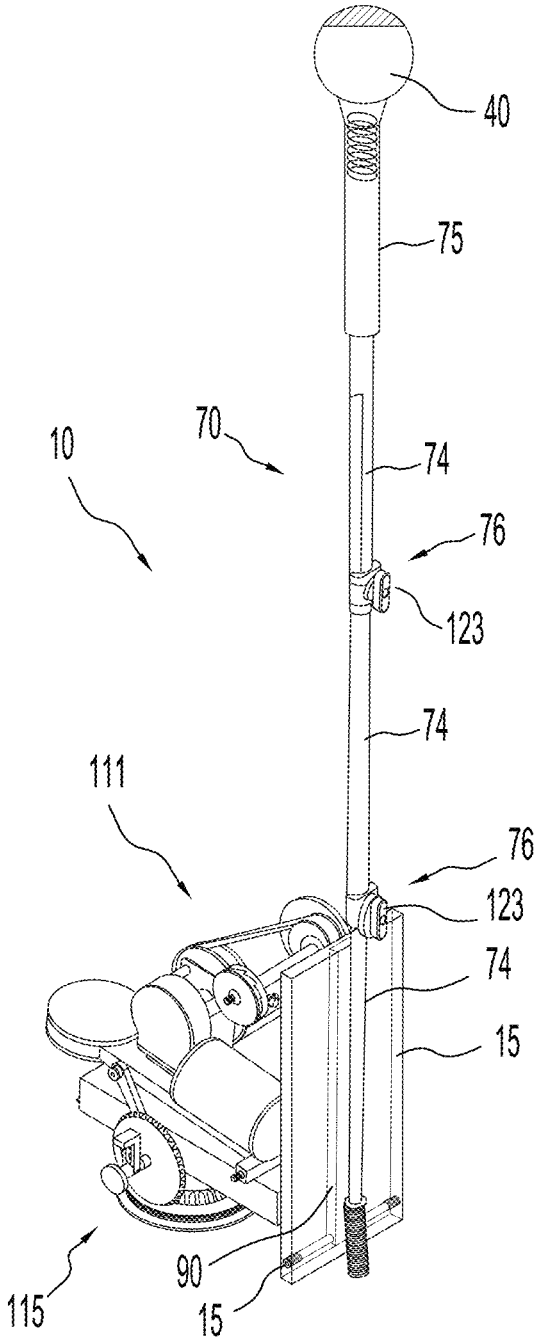
Figure 53:
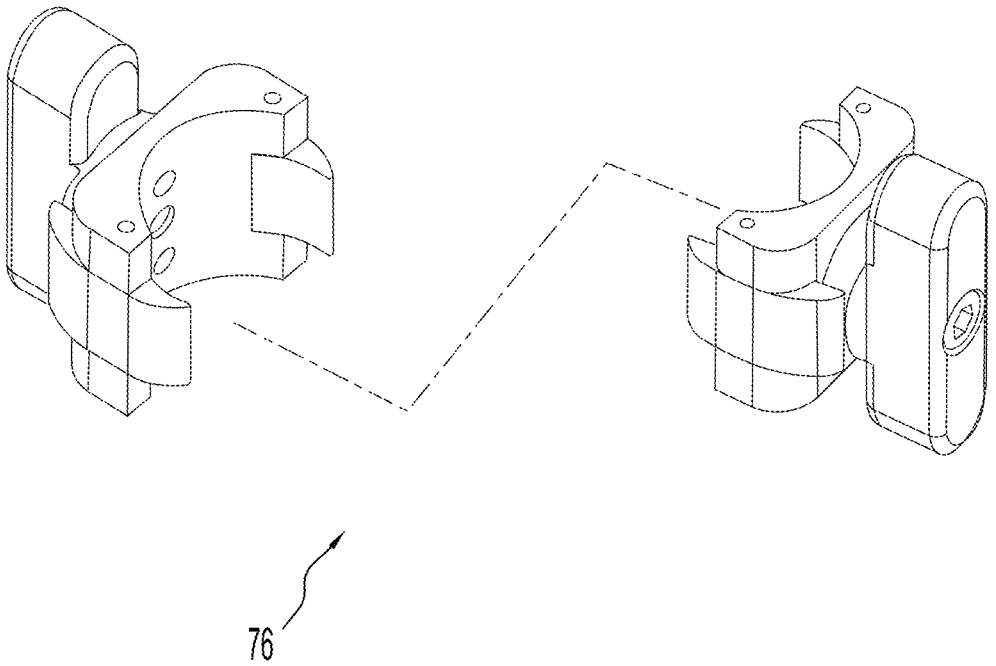
FIG. 53 is a view of an example clamp of the present disclosure.

Once the desired length of the tee assembly 70 is achieved, the user rotates the handles 123 of the clamps 76 in an opposite second direction to thereby lock the tee tubes 74 relative to each other (see FIG. 52). The user also pulls the latch 124 in a fourth direction (see Q4 on FIG. 50) such that the pull knob 121 moves in the first direction (see Q1) thereby causing the drive gear 120 to reengage the spool gear 119. FIG. 53 depicts an exploded view of an example clamp 76.

In certain examples, an apparatus for supporting object such that the object can be hit by a hitting device from the apparatus. The apparatus includes a base configured to rest the ground, a tee assembly pivotally coupled to the base and configured to support the object, a string that tethers the object to the apparatus, and a return system that is activated to thereby retract the string and thereby return the object to the tee assembly after the object is hit from the tee assembly. A lift assembly is coupled to the tee assembly, and the lift assembly configured to change the length of the tee assembly such that the ball is in a position to be hit from the tee assembly.

In certain examples the tee assembly has a carriage spring and wherein the lift assembly selectively compresses the carriage spring to thereby reduce the length of the tee assembly. In certain examples, a pedal is depressed to thereby actuate the lift assembly to thereby compress the carriage spring. In certain examples, the lift assembly includes a spool gear and a drive gear, and wherein depressing the pedal causes the drive gear to rotate the spool gear such that a first cable end of a cable compresses the carriage spring and a second end of the cable is wound about the spool gear. In certain examples, the lift assembly includes a spool gear, a drive gear coupled to the spool gear, and a pull knob configured to decouple the drive gear from the spool gear to thereby change the length of the tee assembly. In certain examples, the tee assembly has a tee tube in which the carriage spring and a carriage are received and a cup that is coupled to the carriage and encircling the tee tube, and wherein the carriage spring moves the carriage and the cup together. In certain examples, as the return system retract the string, the string causes the tee assembly to pivot from a pivoted position to a stationary position and the lift assembly increases length of the tee assembly such that the tee assembly is in the practice position and the object is moved from a first object position to a second object position.

In certain examples, wherein the tee assembly has an object capture spring that engages the object while the tee assembly is in and is moved between the pivot position and the stationary position. In certain examples, when the lift assembly increases length of the tee assembly, the object separates from the object capture spring. In certain examples, the object has a plunger that axially extends from a body of the object when the object engages an object capture spring of the tee assembly and the plunger axially retracts into the body when the tee assembly is moved into the practice position. In certain examples, the object has a spring that biases the plunger into the body of the object. In certain examples, the plunger is coupled to the string via a string clip and a pair of bearings and wherein the pair of bearing permit the object to rotates related to the string.

In certain examples, the return system includes a motor on a platform that selectively tensions and drives a belt that rotates a drum, and wherein rotation of the drum causes a string spool to rotate and thereby retract the string and wind the string therearound. In certain examples, a pedal is depressed to thereby activate the motor and cause the belt to rotate the drum. In certain examples, the return system has a delayed braking assembly that allows temporary free flight of the object before activating to thereby decrease speed of the unwinding of the string and the speed of the object. In certain examples, the delayed braking assembly is coupled to the drum via a drum gear. In certain examples, the delayed braking assembly includes a spring and an adjusting nut that is selectively rotated to thereby compress the spring and further decreases speed of the retracting of the string. In certain examples, the return system includes a string spool about which the string is wound, a magnet coupled to the string spool, and a sensor configured to sense movement of the string spool and thereby determine the speed of the object when hit away from the system and before being retracted by the return system.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for supporting an object such that the object can be hit by a hitting device from the apparatus, the apparatus comprising:

a base;

a tee assembly with a first end and an opposite second end, wherein the first end is pivotally coupled to the base and a second end is configured to support the object thereon;

a coupling device configured to tether the object to the apparatus;

a return system that is activated to thereby retract the coupling device and thereby configured to return the object to the tee assembly after the object is hit from the tee assembly; and a lift assembly coupled to the tee assembly, the lift assembly moves the second end of the tee assembly toward the first end of the tee assembly as the return system returns the object to the tee assembly.

2. The apparatus according to claim 1, wherein as the return system retracts the coupling device, the coupling device acts on the tee assembly and thereby pivots the tee assembly from a pivoted position to a stationary position.

3. The apparatus according to claim 1, wherein the lift assembly is coupled to the tee assembly via a cable, and wherein when the lift assembly is activated, the lift assembly tensions the cable such that the cable moves the second end of the tee assembly toward the first end of the tee assembly.

4. An apparatus for supporting an object such that the object can be hit by a hitting device from the apparatus, the apparatus comprising:

a base;

a tee assembly pivotally coupled to the base and configured to support the object:

a coupling device that tethers the object to the apparatus:

a return system that is activated to thereby retract the coupling device and thereby return the object to the tee assembly after the object is hit from the tee assembly; and a lift assembly coupled to the tee assembly, the lift assembly configured to change a length of the tee assembly such that the object is in a position to be hit from the tee assembly;

wherein the tee assembly has a carriage spring and wherein the lift assembly selectively compresses the carriage spring to thereby reduce the length of the tee assembly.

5. The apparatus according to claim 4, further comprising a pedal that is depressed to thereby actuate the lift assembly to thereby compress the carriage spring.

6. The apparatus according to claim 5, wherein the lift assembly includes a spool gear and a drive gear, and wherein depressing the pedal causes the drive gear to rotate the spool gear such that a first cable end of a cable compresses the carriage spring and a second end of the cable is wound about the spool gear.

7. The apparatus according to claim 4, wherein the lift assembly includes a spool gear, a drive gear coupled to the spool gear, and a pull knob configured to decouple the drive gear from the spool gear to thereby change the length of the tee assembly.

8. The apparatus according to claim 4, the tee assembly has a tee tube in which the carriage spring and a carriage are received and a cup that is coupled to the carriage and encircling the tee tube, and wherein the carriage spring moves the carriage and the cup together.

9. An apparatus for supporting an object such that the object can be hit by a hitting device from the apparatus, the apparatus comprising:

a base;

a tee assembly pivotally coupled to the base and configured to support the object:

a coupling device that tethers the object to the apparatus:

a return system that is activated to thereby retract the coupling device and thereby return the object to the tee assembly after the object is hit from the tee assembly; and a lift assembly coupled to the tee assembly, the lift assembly configured to change a length of the tee assembly such that the object is in a position to be hit from the tee assembly;

wherein as the return system retracts the coupling device, the coupling device causes the tee assembly to pivot from a pivoted position to a stationary position;

wherein the lift assembly increases the length of the tee assembly such that the tee assembly is in a practice position and the object is moved from a first object position to a second object position; and wherein the tee assembly has an object capture spring that engages the object while the tee assembly is in and is moved between the pivot position and the stationary position.

10. The apparatus according to claim 9, wherein when the lift assembly increases length of the tee assembly, the object separates from the object capture spring.

11. An apparatus for supporting an object such that the object can be hit by a hitting device from the apparatus, the apparatus comprising:

a base;

a tee assembly pivotally coupled to the base and configured to support the object:

a coupling device that tethers the object to the apparatus:

a return system that is activated to thereby retract the coupling device and thereby return the object to the tee assembly after the object is hit from the tee assembly; and a lift assembly coupled to the tee assembly, the lift assembly configured to change a length of the tee assembly such that the object is in a position to be hit from the tee assembly;

wherein as the return system retracts the coupling device, the coupling device causes the tee assembly to pivot from a pivoted position to a stationary position;

wherein the lift assembly increases the length of the tee assembly such that the tee assembly is in a practice position and the object is moved from a first object position to a second object position; and wherein the object has a plunger that axially extends from a body of the object when the object engages an object capture spring of the tee assembly and the plunger axially retracts into the body when the tee assembly is moved into the practice position.

12. The apparatus according to claim 11, wherein the object has a spring that biases the plunger into the body of the object.

13. The apparatus according to claim 12, wherein the plunger is coupled to the coupling device via a string clip and a pair of bearings, and wherein the pair of bearings permit the object to rotate relative to the coupling device.

14. An apparatus for supporting an object such that the object can be hit by a hitting device from the apparatus, the apparatus comprising:

a base;

a tee assembly pivotally coupled to the base and configured to support the object:

a coupling device that tethers the object to the apparatus:

a return system that is activated to thereby retract the coupling device and thereby return the object to the tee assembly after the object is hit from the tee assembly; and a lift assembly coupled to the tee assembly, the lift assembly configured to change a length of the tee assembly such that the object is in a position to be hit from the tee assembly;

wherein the return system includes a motor on a platform that selectively tensions and drives a belt that rotates a drum, and wherein rotation of the drum causes a string spool to rotate and thereby retract the coupling device and wind the coupling device therearound.

15. The apparatus according to claim 14, further comprising a pedal that is depressed to thereby activate the motor and cause the belt to rotate the drum.

16. The apparatus according to claim 14, wherein the return system has a delayed braking assembly that allows temporary free flight of the object before activating to thereby decrease speed of the unwinding of the coupling device and thereby speed of the object.

17. The apparatus according to claim 16, wherein the delayed braking assembly is coupled to the drum via a drum gear.

18. The apparatus according to claim 17, wherein the delayed braking assembly includes a spring and an adjusting nut that is selectively rotated to thereby compress the spring and further decreases speed of the unwinding of the coupling device.

19. An apparatus for supporting an object such that the object can be hit by a hitting device from the apparatus, the apparatus comprising:

a base;

a tee assembly pivotally coupled to the base and configured to support the object:

a coupling device that tethers the object to the apparatus:

a return system that is activated to thereby retract the coupling device and thereby return the object to the tee assembly after the object is hit from the tee assembly; and a lift assembly coupled to the tee assembly, the lift assembly configured to change a length of the tee assembly such that the object is in a position to be hit from the tee assembly;

wherein the return system includes a string spool about which the coupling device is wound, a magnet coupled to the string spool, and a sensor configured to sense movement of the string spool and thereby determine the speed of the object when hit away from the system and before being retracted by the return system.

* * * * *